US012760634B2

(12) United States Patent
Uddenberg

(10) Patent No.: US 12,760,634 B2
(45) Date of Patent: Oct. 13, 2026

(54) IN SITU LEACHING OF COPPER FROM PORPHYRY COPPER ORE BODIES THROUGH STIMULATED NATURAL FRACTURE NETWORKS

(71) Applicant: Skouria LLC, Philadelphia, PA (US)

(72) Inventor: Matt Uddenberg, Philadelphia, PA (US)

(73) Assignee: SKOURIA LLC, Philadelphia, PA (US)

( * ) Notice: Subject to any disclaimer, the term of this patent is extended or adjusted under 35 U.S.C. 154(b) by 0 days.

(21) Appl. No.: 19/237,973

(22) Filed: Jun. 13, 2025

(65) Prior Publication Data

US 2025/0389179 A1 Dec. 25, 2025

Related U.S. Application Data

(60) Provisional application No. 63/661,854, filed on Jun. 19, 2024.

(51) Int. Cl.
*C22B 15/00* (2006.01)
*C22B 1/00* (2006.01)
(Continued)

(52) U.S. Cl.
CPC ..... *E21B 43/283* (2013.01); *C22B 1/00* (2013.01); *C22B 3/065* (2013.01); *C22B 3/205* (2013.01);
(Continued)

(58) Field of Classification Search
CPC .... E21B 43/283; E21B 43/267; E21B 43/305; E21B 49/00; C22B 1/00; C22B 3/062;
(Continued)

(56) References Cited

U.S. PATENT DOCUMENTS 2,850,270 A 9/1958 Hanson
3,574,599 A 4/1971 Ortloff et al.
(Continued)

FOREIGN PATENT DOCUMENTS

WO 2015031943 3/2015
WO 2019081892 5/2019
WO 2024077842 4/2024

OTHER PUBLICATIONS

Mantilla et al., Insights into the use of green leaching systems based on glycine for the selective recovery of copper, Minerals Engineering 206, 108534, 2024, 15 pages.
(Continued)

*Primary Examiner* — Benjamin F Fiorello
(74) *Attorney, Agent, or Firm* — Thorpe North & Western, LLP

(57) ABSTRACT

A method of leaching copper from a porphyry copper ore body within a subsurface volume of rock can include forming an injection well in the ore body and stimulating the injection well in a hybrid stimulation phase including a first hydraulic fracturing phase at an injection rate and pressure exceeding $Sh_{min}$ to form hydraulic fractures that intersect with a first set of natural fractures; a first hydroshearing phase holding the injection rate until hydraulic fracture growth is allowed to arrest; mapping the first set of natural fractures using a micro-seismic array to form a stimulated natural fracture map; and emplacing a proppant in the fractures. A production well can be drilled into the stimulated propped fractures, and the production well can be stimulated in a second hydroshearing phase to stimulate a portion of the first set of natural fractures intersecting with the production well.

28 Claims, 12 Drawing Sheets

(51) Int. Cl.

| | |
|---|---|
| ***C22B 3/06*** | (2006.01) |
| ***C22B 3/20*** | (2006.01) |
| ***E21B 43/267*** | (2006.01) |
| ***E21B 43/28*** | (2006.01) |
| ***E21B 43/30*** | (2006.01) |
| ***E21B 49/00*** | (2006.01) |

(52) U.S. Cl.
CPC ..... *C22B 15/0008* (2013.01); *C22B 15/0073* (2013.01); *C22B 15/0084* (2013.01); *E21B 43/267* (2013.01); *E21B 43/305* (2013.01); *E21B 49/00* (2013.01)

(58) Field of Classification Search
CPC . C22B 3/205; C22B 15/0008; C22B 15/0073; C22B 15/0084
See application file for complete search history.

(56) References Cited

U.S. PATENT DOCUMENTS

| | | | | |
|---|---|---|---|---|
| 3,815,957 | A | 6/1974 | Spedden et al. | |
| 3,822,916 | A * | 7/1974 | Jacoby | E21B 43/283 166/299 |
| 3,841,705 | A | 10/1974 | Girard et al. | |
| 3,881,774 | A | 5/1975 | Van Poolen et al. | |
| 3,890,007 | A | 6/1975 | Heinen et al. | |
| 4,045,084 | A | 8/1977 | Hsueh et al. | |
| 4,116,488 | A | 9/1978 | Hsueh et al. | |
| 4,163,580 | A | 8/1979 | Pearson et al. | |
| 4,291,920 | A | 9/1981 | Lingane et al. | |
| 4,342,484 | A * | 8/1982 | Davidson | C09K 8/80 299/5 |
| 4,545,620 | A * | 10/1985 | Curtin | E21B 43/28 299/4 |
| 6,123,394 | A * | 9/2000 | Jeffrey | E21C 41/16 166/308.1 |
| 6,319,389 | B1 | 11/2001 | Fountain et al. | |
| 10,683,739 | B2 | 6/2020 | Nguyen et al. | |
| 10,808,530 | B1 | 10/2020 | Munk et al. | |
| 2016/0123096 | A1 * | 5/2016 | Mathieson | E21C 41/16 175/50 |
| 2023/0174848 | A1 * | 6/2023 | Uddenburg | E21B 43/267 |

OTHER PUBLICATIONS

Eksteen et al., A conceptual process for copper extraction from chalcopyrite in alkaline glycinate solutions, Minerals Engineering 108, 2017, pp. 53-66.

Shin et al., Kinetic study of copper leaching from chalcopyrite concentrate in alkaline glycine solution, Hydrometallurgy 183, 2019, pp. 71-78.

Tanda, et al., An investigation into the leaching behaviour of copper oxide minerals in aqueous alkaline glycine solutions, Hydrometallurgy 167, 2017, pp. 153-162.

* cited by examiner

IN SITU LEACHING OF COPPER FROM PORPHYRY COPPER ORE BODIES THROUGH STIMULATED NATURAL FRACTURE NETWORKS

CROSS REFERENCE TO RELATED APPLICATIONS

This application claims priority to U.S. Provisional Application No. 63/661,854, filed on Jun. 19, 2024, which is hereby incorporated herein by reference.

BACKGROUND

Most of the world's copper is found in deposits called Porphyry Copper Deposits (PCDs). The three main types of PCDs include plutonic, volcanic, and classic types. Plutonic porphyry copper deposits occur in batholithic settings where mineralization is emplaced in one or more phases. Volcanic porphyry copper deposits occur in the roots of volcanoes, with mineralization both in the volcanic rocks and in associated comagmatic plutons. Classic porphyry copper deposits occur with high-level, post-orogenic stocks that intrude unrelated host rocks; mineralization may occur entirely in the country rock. The earliest mined deposits, as well as most Cenozoic porphyry copper deposits, are of the classic type.

In all cases, these deposits are defined by their source, which is porphyritic magma. Porphyritic magmas are the result of multi-stage cooling. Typically, it is where a slow cooling magma is disturbed in some fashion, which causes it to become rapidly transported closer to surface where it cools at a much faster rate. Copper containing porphyry tends to have a high concentration of volatiles (water, carbon dioxide etc.) and during the rapid cooling phase of the porphyritic magma these volatiles are expelled at high pressures and in some cases hydraulically fracture the "country rock" (previously existing rock). This results in hydrothermal systems that transport the volatiles/fluid toward the surface through a series of fractures. Over time these fractures will begin to fill with various alteration minerals. This occurs as the transported fluid precipitates out different minerals in response to changes in pressure and temperature. One of the mineral groups that are precipitated out of solution are sulfides, which tend to entrain iron and precious metals into their crystal structure. Most commercial copper resources being exploited today are characterized by sulfides found within old hydrothermal systems where fluid and heat were sourced by porphyritic magma. The type of deposit (Plutonic, Volcanic, Classic) is a function of the lithology of the rock where this sulfide precipitation occurs.

While PCD's can be found in a variety of environments, they are most prevalent in volcanic arc regions, and, therefore, are commonly associated with plutonic or volcanic settings. Many, but not all, PCDs are defined by sulfides contained within fractures filled with alteration minerals (veins), which are the roots, trunks, and branches of old hydrothermal systems. In some cases, these hydrothermal fluids find their way into a porous media (often a metasediment/sediment), and in such cases, copper containing sulfides will be disseminated throughout the pore space of the rock. These cases constitute a "classic" ore body.

As the orebody is uplifted and exposed to meteoric waters, all or part of the orebody will become oxidized. Therefore, in addition to the volcanic, plutonic, and classic categories, there is also the distinction of copper oxide and copper sulfide type of ore bodies. Copper oxide ore bodies tend to be located closer to the surface and are easier to process, which is why until recently these type of ore bodies were the main sources of copper. Copper sulfides tend to be deeper, less permeable, and harder to process. It is for these reasons that copper sulfide deposits represent the largest new potential source of copper going forward.

Most of the copper produced up until today has been from shallow resources exposed at the surface due to tectonic uplift. Geochemical analysis show that most PCDs are emplaced at a depth of 1-4 km. This means that it is highly likely that most of the copper ore bodies yet to be found are deep and most of these orebodies will be defined by sulfide filled fractures. The mining methods currently being used to develop these deep sulfide resources all require building a deep mine shaft to enable physical removal of the rock from deep in the subsurface. All methods relying on the physical removal of rock from the subsurface are very capital intensive and will be cost prohibitive for many of these deep resources. In addition to copper, other precious metals such as Gold, Silver and Molybdenum are also common within PCDs.

In situ leaching provides a potential solution for mining deep PCDs in a cost-effective manner. In situ leaching is a method whereby lixiviant is injected into the rock to dissolve copper out of an ore body, have the copper go into solution, and bring the resultant solution to the surface. The promise of such a method is that it significantly reduces the initial capital costs of developing deep PCDs compared with conventional methods. For example, drilling treatment wells to 1830 m (6,000 ft) can be roughly $1/10^{th}$ the cost of sinking a mine shaft to the same depth.

Despite its advantages, in situ leaching is rare in porphyry systems. Past demonstrations encountered a host of challenges, including the formation of fast paths in the leaching reservoir; insufficient exposure of chemical treatment to sulfide minerals contained in the rock; insufficient control of fluid migration; and precipitation of metals in the reservoir.

SUMMARY

A method of leaching copper from a porphyry copper ore body within a subsurface volume of rock can include forming an injection well adjacent to or within the porphyry copper ore body. The method can further include forming at least one lateral injection hole extending from the injection well. The at least one lateral injection hole can be stimulated through the injection well under a hybrid stimulation phase. The hybrid stimulation phase can include a first hydraulic fracturing phase at an injection rate and a pressure which exceeds the minimum principal horizontal stress ($Sh_{min}$) such that a first set of hydraulic fractures are formed which extend from the at least one lateral injection hole to intersect with a first set of natural fractures. The hybrid stimulation phase can also include a first hydroshearing phase, where the injection rate is held at a target rate until hydraulic fracture growth is allowed to arrest, and leak-off into the natural fractures, which become a dominant pressure sink. The hybrid stimulation phase further includes mapping the first set of natural fractures during stimulation using a microseismic array to form a stimulated natural fracture map, and emplacing a proppant in the first set of hydraulic fractures and the first set of natural fractures to form a first set of stimulated propped hydraulic fractures and a first set of stimulated propped natural fractures. The method further includes drilling at least one production well adjacent to or within the first set of stimulated natural fractures using the stimulated natural fracture map. At least one production well can also be completed using a hybrid open hole completion where a production interval is completed using a blank liner and external casing packers. The method also includes stimulating the at least one production well under a second hydroshearing phase, where an injection pressure is held near $Sh_{min}$, such that a portion of the first set of natural fractures intersected by the production well are preferentially stimulated. A proppant can be emplaced in the natural fractures intersected by the production well to form a set of stimulated propped natural fractures. Copper can then be leached from the porphyry copper ore body by contacting a leaching fluid with the porphyry copper ore body via the stimulated reservoir to form a copper-laden solution.

There has thus been outlined, rather broadly, the more important features of the invention so that the detailed description thereof that follows may be better understood, and so that the present contribution to the art may be better appreciated. Other features of the present invention will become clearer from the following detailed description of the invention, taken with the accompanying drawings and claims, or may be learned by the practice of the invention.

Figure 1A:
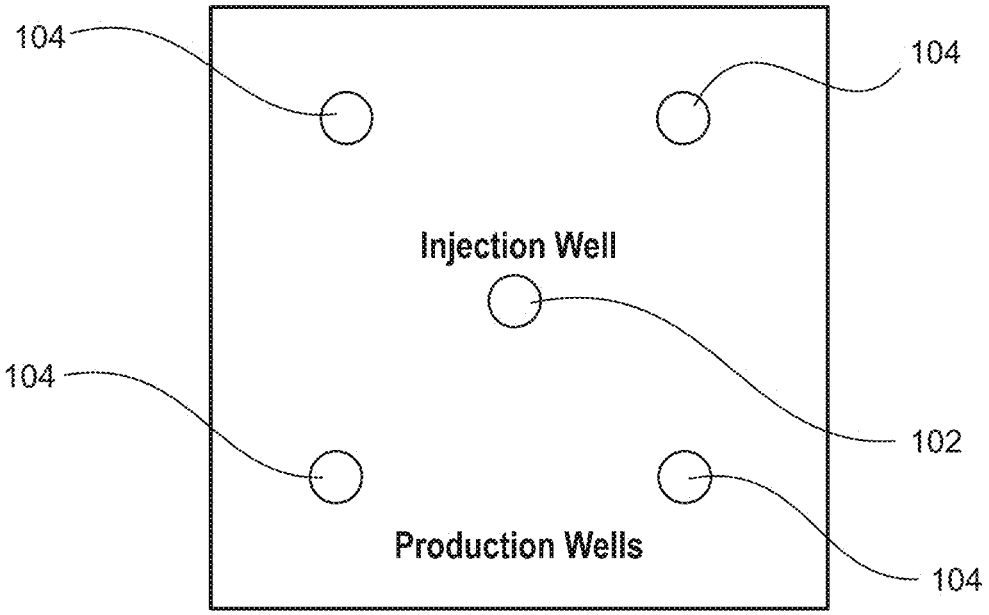
FIG. 1A shows a map view of a pod system with one injection well and four production wells in accordance with one example.

These drawings are provided to illustrate various aspects of the invention and are not intended to be limiting of the scope in terms of dimensions, materials, configurations, arrangements or proportions unless otherwise limited by the claims.

DETAILED DESCRIPTION

While these exemplary embodiments are described in sufficient detail to enable those skilled in the art to practice the invention, it should be understood that other embodiments may be realized and that various changes to the invention may be made without departing from the spirit and scope of the present invention. Thus, the following more detailed description of the embodiments of the present invention is not intended to limit the scope of the invention, as claimed, but is presented for purposes of illustration only and not limitation to describe the features and characteristics of the present invention, to set forth the best mode of operation of the invention, and to sufficiently enable one skilled in the art to practice the invention. Accordingly, the scope of the present invention is to be defined solely by the appended claims.

Definitions

In describing and claiming the present invention, the following terminology will be used.

The singular forms "a," "an," and "the" include plural referents unless the context clearly dictates otherwise. Thus, for example, reference to "a well" includes reference to one or more of such features and reference to "stimulating" refers to one or more of such steps.

As used herein with respect to an identified property or circumstance, "substantially" refers to a degree of deviation that is sufficiently small so as to not measurably detract from the identified property or circumstance. The exact degree of deviation allowable may in some cases depend on the specific context.

As used herein, "adjacent" refers to the proximity of two structures or elements. Particularly, elements that are identified as being "adjacent" may be either abutting or connected. Such elements may also be near or close to each other without necessarily contacting each other. The exact degree of proximity may in some cases depend on the specific context.

As used herein, the term "about" is used to provide flexibility and imprecision associated with a given term, metric or value. The degree of flexibility for a particular variable can be readily determined by one skilled in the art.

However, unless otherwise enunciated, the term "about" generally connotes flexibility of less than 2%, and most often less than 1%, and in some cases less than 0.01%.

As used herein, "Porphyry Copper Deposits (PCDs)" refers to a type of ore body found proximal to porphyritic magma, where the ore is often defined by metal sulfides such as pyrite and chalcopyrite. Porphyritic magmas are magmas that undergo two stages of cooling. The first stage of cooling is slow, and the second stage of cooling is fast. This leads to an igneous rock where there are large minerals grains surrounded by a fine-grained matrix. The large mineral grains form during slow cooling, and the fine-grained matrix is the result of rapid cooling of the melt. During rapid cooling, CO2, water and other volatiles are expelled from the melt, along with metals. This fluid enriched in metals then makes its way toward the surface through hydrothermal systems. Metals are often precipitated as sulfides on the fracture walls where these fluids travel. These sulfides constitute the ore body.

As used herein, "External Casing Packers (ECP)" refers to a device used to mechanically isolate a section of wellbore. It works by expanding an element installed on a drill pipe or injection line, often an elastomer, so that element is flush with an open or cased hole. This expanded element provides a pressure seal so that high-pressure injection can be contained to a specific zone within a well. An external casing packer is similar to a classical packer, however, instead of being installed on a drill pipe or injection line it is installed on liner or piece of casing. This prevents the need to cement the liner or casing in place and leaves mechanically isolated segments of open wellbore behind the liner.

As used herein, "Lixiviant" refers to a chemical used in hydrometallurgy to extract elements from its ore. One of the most famous lixiviants is cyanide, which is used in extracting 90% of mined gold.

As used herein, "Alkaline" refers to a solution with a pH above 7.

As used herein, "Acid" refers to a solution with a pH below 7.

As used herein, "Pod" refers to a well configuration where a central injection well is flanked/surrounded by one or more production wells. Generally, all production wells can be a similar radial distance away from the injection well along a vertical plane whose orientation is perpendicular to the direction of the central injection well.

As used herein, "Alteration Minerals" refers to Minerals which result from the interaction of fluid or magma with surrounding country rock. Where country rock is defined as the existing rock into which fluids or magma is intruding. Common alteration minerals are sulfides, quartz, epidote, hematite, chlorite, various clays and various micas. Alteration minerals are often found on the margins of dikes or the surface of natural fractures.

As used herein, "PLA: Poly Lactic Acid" refers to a type of polymer formed from lactic acid that is biodegradable and thermally degradable. Most common use cases of PLA are as a material for biodegradable kitchenware and as diverting agent in oil and gas applications. It is widely used because it is cheap, robust, and the polymer thermally degrades at low temperatures. These properties make it very well suited for both applications described.

As used herein, "$Sh_{min}$" refers to minimum horizontal stress which is the least principal stress direction along the horizontal plane. It can be best thought of as a vector with a magnitude and direction. The magnitude is given in terms of pressure and the direction is given in terms of orientation on a horizontal plane. $Sh_{min}$ defines the pressure required to fail rock in tension at a given depth. This pressure threshold is sometime called the fracture closure pressure. The direction of $Sh_{min}$ is the direction in which a hydraulic fracture will open, and hydraulic fracture propagation will be perpendicular to this direction. For this reason, it is beneficial for wells to be drilled in the direction of $Sh_{min}$. The magnitude of $Sh_{min}$ depends on the specific rock formation and depth. In some examples, $Sh_{min}$ can be in the range of about 0.4 psi to about 1.0 psi per foot of depth (or about 10-25 kPa per meter of depth). $Sh_{min}$ can be measured by tests including leak-off tests (LOT), extended leak-off tests (XLOT), or microfrac tests.

As used herein, "Sulfide" refers to an inorganic anion of sulfur with the chemical formula S or a compound containing one or more S ions. In this context sulfides often refer to metallic sulfides, where sulfur is bonded with a metal.

As used herein, "Ore Body" refers to a volume of rock containing metals that can be economically recovered.

As used herein, "Head" refers to a water level (often in feet or meters) above some reference depth. Often head is used in reference to pumps, where a certain water level above the pump is required for operations.

As used herein, "Stimulation" refers to the application of various techniques used to increase permeability in the subsurface. The most common stimulation techniques use injection pressure to create hydraulic fractures or stimulate natural fractures. However, thermal and chemical stimulation techniques are also used to enhance permeability.

As used herein, "Permeability" refers to a physical property of porous systems and fractures, equal to the ratio of volumetric flux to the potential gradient for a unit-mobility fluid. It is used to help determine the flow rate of fluid through a material given an imposed pressure.

As used herein, "Chemical Complex" refers to a coordination complex which is a chemical compound consisting of a central atom or ion, which is usually metallic and is called the coordination center, and a surrounding array of bound molecules or ions, that are in turn known as ligands or complexing agents.

As used herein, "Lateral" refers to a well or a section of well that is drilled at angle greater than 0 degrees from vertical. In some cases, a lateral well can be drilled at about a 90 degree angle, but in other cases, the lateral well can be drilled at varied angles depending on the surrounding rock characteristics and target locations.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

As used herein, the term "at least one of" is intended to be synonymous with "one or more of." For example, "at least one of A, B and C" explicitly includes only A, only B, only C, or combinations of each.

Numerical data may be presented herein in a range format. It is to be understood that such range format is used merely for convenience and brevity and should be interpreted flexibly to include not only the numerical values explicitly recited as the limits of the range, but also to include all the individual numerical values or sub-ranges encompassed within that range as if each numerical value and sub-range is explicitly recited. For example, a numerical range of about 1 to about 4.5 should be interpreted to include not only the explicitly recited limits of 1 to about 4.5, but also to include individual numerals such as 2, 3, 4, and sub-ranges such as 1 to 3, 2 to 4, etc. The same principle applies to ranges reciting only one numerical value, such as "less than about 4.5," which should be interpreted to include all of the above-recited values and ranges. Further, such an interpretation should apply regardless of the breadth of the range or the characteristic being described.

Any steps recited in any method or process claims may be executed in any order and are not limited to the order presented in the claims. Means-plus-function or step-plus-function limitations will only be employed where for a specific claim limitation all of the following conditions are present in that limitation: a) "means for" or "step for" is expressly recited; and b) a corresponding function is expressly recited. The structure, material or acts that support the means-plus function are expressly recited in the description herein. Accordingly, the scope of the invention should be determined solely by the appended claims and their legal equivalents, rather than by the descriptions and examples given herein.

Example Embodiments

A technology is described for stimulation of subsurface Porphyry Copper Deposits (PCDs) at greater than 150 meters depth for the purpose of metal extraction. The stimulation method can enable economic copper recovery from targeted deep ore bodies using an alkaline or acidic lixiviant to leach copper and other metals from sulfides contained in a stimulated reservoir. The in situ leaching method can use an injection well flanked by one or more production wells to transport treatment fluid (lixiviant) through a stimulated reservoir. The methods described herein can allow greater recovery of copper from deep ore bodies compared to other in situ leaching methods. These methods can provide better control over fluid migration through the copper ore body than has been achieved before. The stimulation methods used can prevent the formation of fast paths, which would "short circuit" the leaching of much of the copper contained in the ore body. Additionally, the stimulation methods are capable of rubblizing and removing alteration minerals to increase exposure of copper-containing minerals to leaching.

An example method of leaching copper can be used to leach copper from a porphyry copper ore body within a subsurface volume of rock. The example method can include forming an injection well adjacent to or within a porphyry copper ore body. After forming the injection well, one or more lateral injection holes can be formed extending laterally from the injection well. A particular hybrid stimulation method can be used to stimulate the lateral injection hole. This can be referred to as a hybrid stimulation phase, which can be subdivided into a first hydraulic fracturing phase, a first hydroshearing phase, mapping a first set of natural fractures, and emplacing a proppant in the first set of natural fractures.

In first hydraulic fracturing phase, fracking fluid can be injected at an injection rate and pressure that exceeds a minimum principal horizontal stress ($Sh_{min}$). This can cause a first set a hydraulic fractures to form. The first set of hydraulic fractures can extend from the lateral injection hole to intersect with natural fractures that are already present in the rock.

In the first hydroshearing phase, the injection rate can be held at a target rate until hydraulic fracture growth is allowed to arrest. This can occur because eventually the fluid can leak-off into the natural fractures. Thus, the natural fractures become the dominant pressure sink and fracture growth ceases.

The natural fractures that have thus intersected with the first set of hydraulic fractures (referred to as a first set of natural fractures) can then be mapped using a micro-seismic array to form a stimulated natural fracture map. This map can be used later to determine where to drill production wells.

A proppant can then be placed in the first set of hydraulic fractures and the first set of natural fractures. Thus, these fracture become a first set of stimulated propped hydraulic fractures and a first set of stimulated propped natural fractures.

After this hybrid stimulation phase, one or more production wells can be drilled adjacent to or within the first set of stimulated propped natural fractures. The stimulated natural fracture map can be used to determine the locations for the production wells. The production wells can either be within the first set of stimulated propped natural fractures or near enough so that when the production well is stimulated, at least some of the first set of stimulated propped natural fractures can be stimulated through the production well. The one or more production wells can be completed using a hybrid open hole completion where a production interval is completed using a blank liner and external casing packers. The production wells can then be stimulated in a second hydroshearing phase. In this second hydroshearing phase, the injection pressure injected into the production wells can be held near $Sh_{min}$ so that a portion of the first set of natural fractures that are intersected by the production well can be preferentially stimulated. This second hydroshearing phase can be controlled so that no large lateral fractures form that would meet up with the lateral fractures connected to the injection well, because fractures could form fast paths through which leaching fluid would flow without contacting much of the ore body. Instead, the smaller natural fractures can be in fluid communication with the production wells, so that leaching fluid that is later flowed in through the injection well can migrate to the production wells only through the smaller natural fractures.

After stimulating the natural fractures from the production wells in this way, additional proppant can be placed in the natural fractures to form a stimulated reservoir that includes a set of stimulated propped natural fractures. With the reservoir stimulated in this way, leaching can be performed by contacting a leaching fluid with the porphyry copper ore body via the stimulated reservoir to form a copper-laden solution. In some cases, the stimulated reservoir can comprise all stimulated fractures. The copper-laden solution can then be produced through the production wells and the copper can be recovered.

In one example, forming the injection well can include drilling the injection well, and introducing a casing and a lining within the injection well. In these cases, forming the at least one lateral injection hole can be performed using hydra-jetting or a perforation gun. Further, as one example, at least one lateral injection hole can be formed in a direction of the $Sh_{min}$ toward the porphyry copper ore body. As a general guideline, the injection well can be from 150 to 4000 m in depth, while the at least one lateral injection hole includes 1 to 100 perforation or jetted zones which are spaced apart from 5 to 50 m.

In another example, the hybrid stimulation phase further comprises introducing a chemical agent, wherein the chemical agent preferentially removes alteration minerals within the porphyry copper ore body. In one example, the chemical agent has a pH below 7.0 which dissolves a range of alteration minerals. In another example, the chemical agent is alkaline, which preferentially dissolves silica. In still another example, introducing a chemical agent includes at least two treatment stages which include a first chemical treatment which targets common alteration minerals, and a second chemical treatment which targets clays, quartz and sulfides. This can include the use of a variety of alkaline solutions or weak acids such as citric acid. Strong acids are generally avoided as they may prematurely dissolve sulfides.

In another example, the first hydroshearing phase comprises holding the injection rate constant for a time determined by monitoring for a threshold decrease in micro-seismic events recorded by the micro-seismic array. The first hydroshearing phase can also include injecting a surfactant to increase pressure diffusion into the first set of natural fractures. In certain examples, the target rate can be constant throughout the first hydroshearing phase.

In still another optional example, the hybrid stimulation phase further comprises cyclically jacking one or more hydraulic fractures by alternating between a first injection pressure and a second injection pressure, such that a stress orientation of $\sigma 2$ and $\sigma 3$ cyclically vary in a localized volume of rock proximal to the one or more hydraulic fractures so as to increase alignment of the stress orientation with the first set of stimulated natural fractures and increase hydroshearing in these natural fractures. The first injection pressure can be above $Sh_{min}$ and the second injection pressure can be below the first injection pressure. The second injection pressure can be below $Sh_{min}$, equal to $Sh_{min}$, or above $Sh_{min}$. As an example, the injection pressure can be cycled by alternating steps between the first injection pressure and the second injection pressure. In certain examples, this can include alternating between pressures above and below the $Sh_{min}$. For example, the injection pressure can be cycled by 100 to 1000 psi (690 kPa to 6.9 MPa) above and below $Sh_{min}$. In another specific alternative, the injection pressure can be cycled by stepwise increasing the injection pressure above the $Sh_{min}$ to the first injection pressure, and then stepwise decreasing the injection pressure to the second injection pressure. In this case, a stepwise pressure increase of the injection pressure can be from 50 to 500 psi (345 kPa to 3.5 MPa) increments. In yet another example, the first injection pressure can be far above $Sh_{min}$ and the second injection pressure can be about equal to $Sh_{min}$ or slightly above $Sh_{min}$.

In another example, the at least one production well includes three to five production wells. Although not required, the at least one production well can be stimulated and produced in series. Notably, these production wells can be stimulated and produced in series or simultaneously together in groups of two or more through the use of diverters, plugs, etc. In another related example, the at least one production wells can be distributed around the injection well in a hub and spoke configuration, and are about equally distanced from the injection well. In one aspect, at least one production well is completed within the production interval using the blank liner and external casing packers. As a guideline, external casing packers can be set 5-150 meters apart depending on various circumstances. The effect of the external casing packers being mechanical isolation of designated sections of the production interval.

In still another example, the at least one production well can be stimulated under a second hydraulic fracturing phase to form a second set of hydraulic fractures which intersect at least one of the first set of natural fractures and the second set of natural fractures, and which is insufficient to connect the second set of hydraulic fractures with the first set of hydraulic fractures. Notably, such second hydraulic fracturing can be optional unless the production well does not intersect a sufficient portion of the first set of natural fractures.

In another example, a diverter material can be introduced to at least partially block a portion of the first set of natural fractures which are intersected by the at least one production well prior to stimulating the at least one production well under the second hydroshearing phase. In these cases, the diverter material can be a degradable diverter material.

In yet another example, leaching the copper can include introducing glycine which complexes with copper. The leaching the copper can also include introducing nitric acid as an oxidizing agent.

Some example processes that involve leaching copper from ores using glycine are described in WO 2015/031943 to Eksteen et al. and U.S. Pat. No. 4,028,202 A to Amman et al., which are hereby incorporated herein by reference. In one aspect, the leaching the copper can include introducing ammonia which complexes with copper. In still another aspect, the leaching the copper can include introducing glycine and ammonia which complexes with copper. Example processes that can be used to leach copper with glycine and ammonia are described in AU2014317800B2 to Eksteen et al., which is hereby incorporated herein by reference.

Figure 1B:
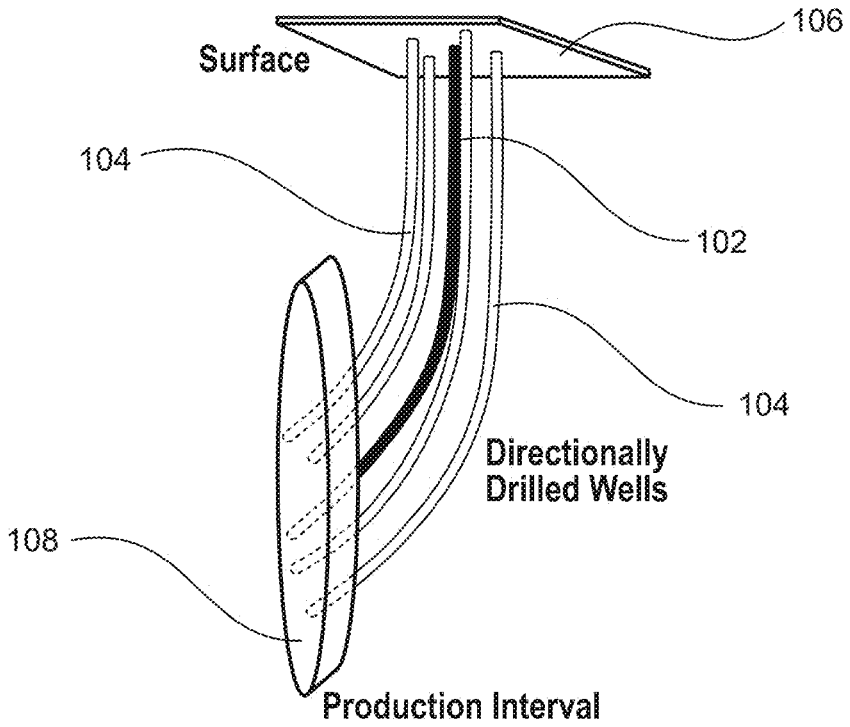
FIG. 1B shows a side view of the pod system of FIG. 1A.

In more detail, FIG. 1A shows an example overhead view of an injection well 102 with four production wells 104 drilled around the injection well, spaced apart from the injection well be approximately the same distance. This is merely one example of how the injection well and production wells can be arranged, and a variety of other arrangements can also be used. FIG. 1B shows a side view of the injection well and production wells. The wells are drilled directionally from the surface 106 down into a production interval 108 that can be within a porphyry copper ore body.

Figure 2:
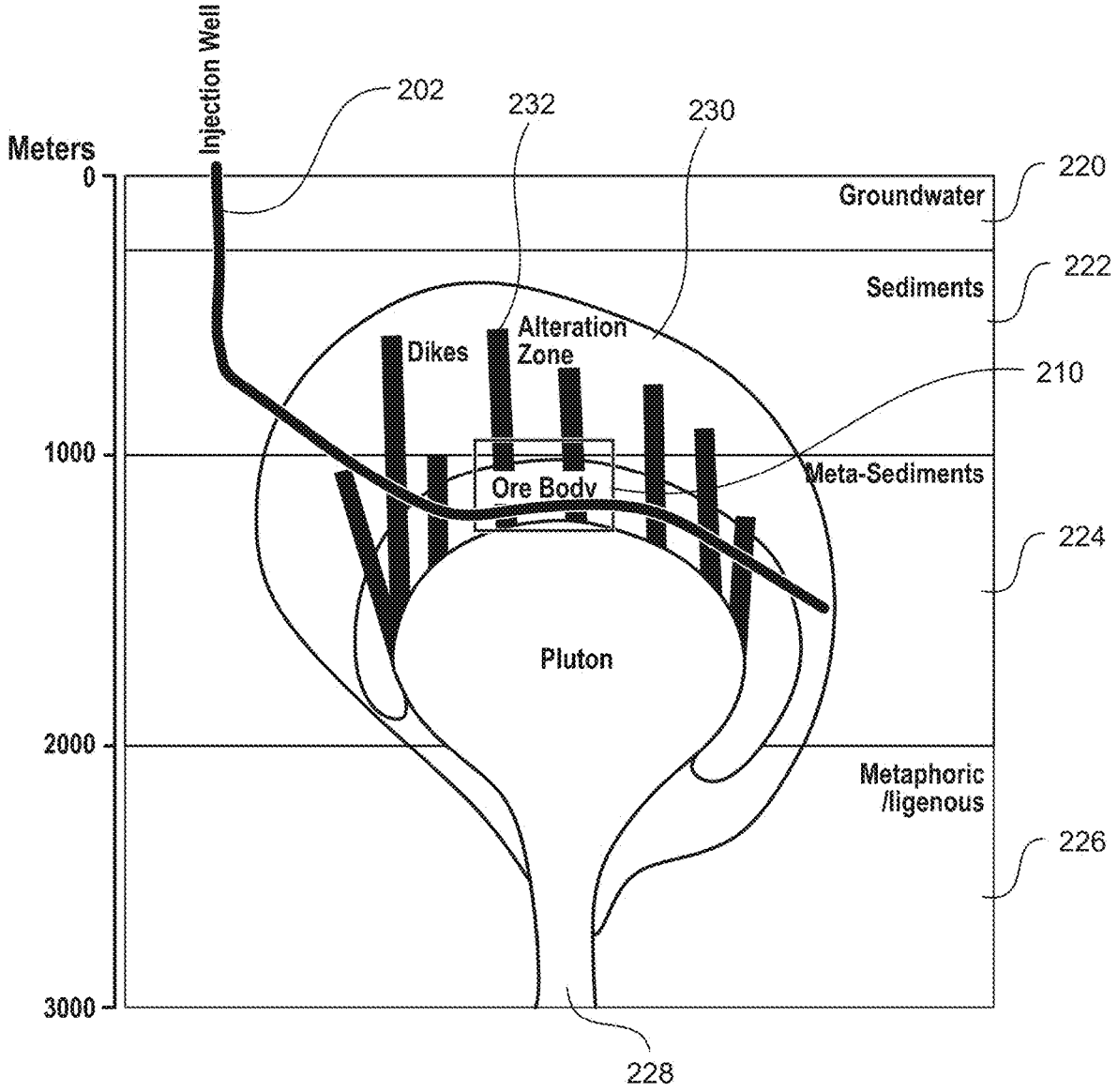
FIG. 2 shows a cross-sectional view of an example injection well drilled perpendicular to the orientation of targeted dikes and/or hydrothermal systems so that it intersects multiple of these systems within a given region in accordance with one example.

In some examples, the injection and production wells can be drilled laterally in the direction of $Sh_{min}$ and the sulfide ore body. FIG. 2 shows an example side view of an injection well 202 drilled into an underground porphyry copper ore body 210. This figure shows several geologic layers, including ground water 220, sediments 222, meta-sediments 224, and metamorphic/igneous rock 226. A pluton 228 penetrates up into the meta-sediment layer. The copper ore body is above the pluton. An alteration zone 230 is above the copper ore body, and dikes 232 extend up into the sediment layer.

Figure 3:
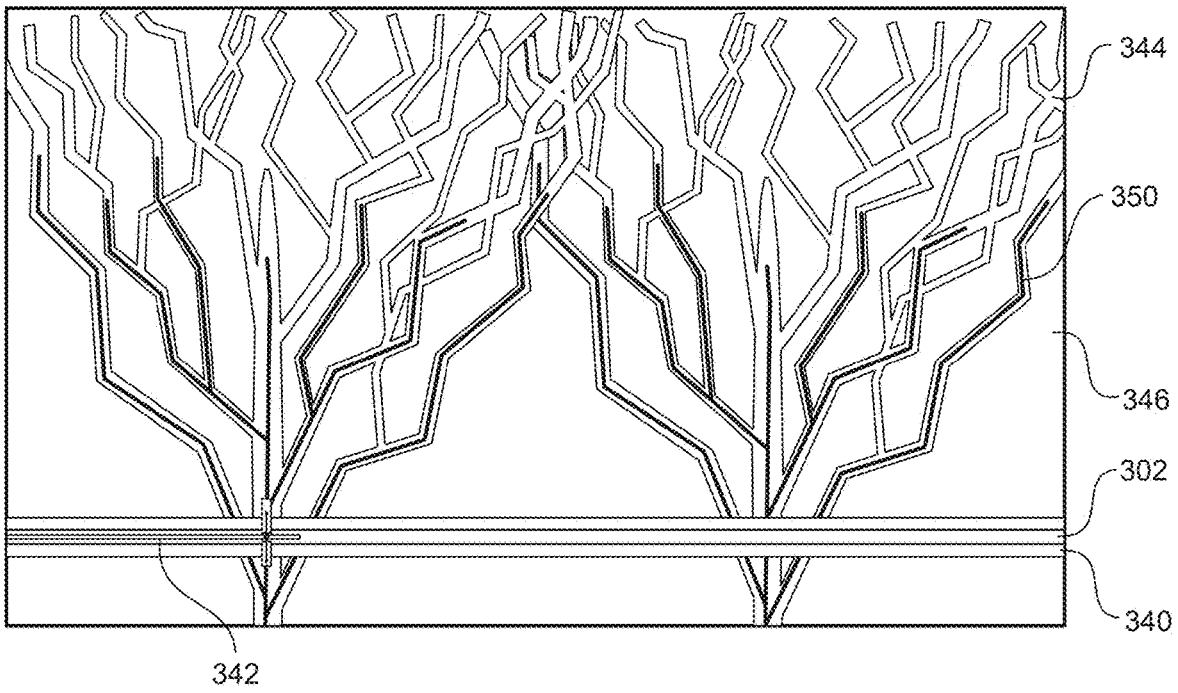
FIG. 3 shows a cross-sectional view of an injection well where it intersects two dike and/or hydrothermal systems in accordance with another example.

The injection well can be completed by cementing and casing the entire production interval (where the well intersects the ore body). Well logging, core analysis, drill cuttings analysis, and various geophysical methods can be used to determine specific locations where perforations (via a perforation gun) or hydra-jetting can be performed. Locations where the cased and cemented well are hydra-jetted or perforated are known as perforated or jetted zones. FIG. 3 shows an example injection well 302 with a casing 340 formed in the copper ore body. Natural fractures 350 are already present in the rock surrounding the injection well. In this figure, a jetting or perforation tool 342 is inserted into the injection well to form lateral injection holes 302. The rock shown in FIG. 3 includes quartz 344 veins in sulfide rock 346. The jetting or perforation can be performed where the injection well intersects with one of these dikes or hydrothermal systems.

Perforation or Hydra-jetting can be performed at 5-150 meter spacing in some examples. Spacing between these jetted or perforated zones may vary based on geological and geophysical analysis. One or more of these jetted or perforated zones can then be mechanically isolated using a downhole plug and packer. Mechanical isolation of a specified zone allows for targeted pressurized fluid injection into selected perforated or jetted zones. Perforation guns are typically used for accessing the reservoir through the casing and setting the fracture initiation point. However, perforation guns do not always create clean holes into the target rock. This is especially true for metamorphic and igneous rocks which are often tougher than shales where perforation guns are typically used. If perforations cause the rock to fracture as opposed to creating a clean hole, it will cause high tortuosity and limit the efficiency of the stimulation. For this reason, it may be beneficial to use the hydra-jetting process, which uses a nozzle to create a focused stream of high-pressured water, laden with an abrasive cutting agent, to cut a clean hole into the casing, cement, and rock. The hydra-jetting tool has the added benefit of protecting the casing from chemical stimulation. This is because the cutting tool will utilize a coil tubing unit or similar kind of system. These systems will isolate the casing from the fluid being injected.

Figure 4:
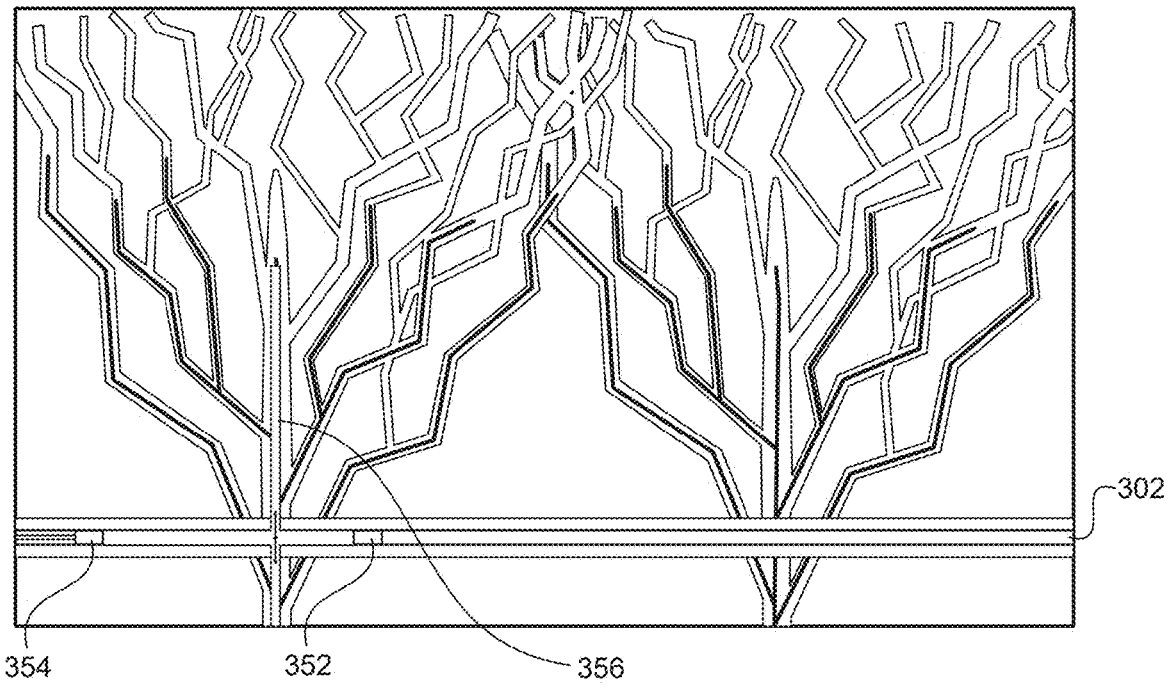
FIG. 4 shows a cross-sectional view in which a jetted/perforated zone is mechanically isolated using a plug and packer and pumped to a pressure above $Sh_{min}$, causing hydraulic fracture propagation in accordance with one example.

During high-pressure stimulation, a plug and perforation/jetting method can be used to attempt to make sure that only one fracture is stimulated at a time. For example, FIG. 4 shows the injection well 302 with a stimulation plug 352 and stimulation packer 354 used to isolate a section of the well. The lateral injection hole is formed and then a first hydraulic fracture 356 is formed. The pressure in the first hydraulic fracture is pumped to a pressure above $Sh_{min}$, causing hydraulic fracture propagation. Hydraulic fracture propagation will then arrest some radial distance from the injection well. This occurs because pressure at the fracture tip is not large enough to breakdown the rock. Typically, this can be performed by stimulating the bottom perforation, emplacing a retrievable or drillable plug once the bottom fracture is stimulated, and then starting on the next perforation. If a perforation gun is used, a retrievable packer attached to the injection line can be used to mechanically isolate the perforation to be stimulated. In the case of jetting, no packer will be required. For cases where there is already sufficient permeability, the method described can be adequate for stimulating the interval. However, in rock without existing permeability another method may be used. This method involves skipping a perforation when a plug is set until the top of the interval is reached, going back, removing the plugs, and stimulating the skipped perforations one at a time starting from the bottom. The point of this method is to change the stress state in the rock proximal to the wellbore in such a way as to cause the second set of hydraulic fracture to have a different orientation and/or dilate and shear existing natural fractures in between the previously emplaced fractures. Natural fractures tend to be native ancient geothermal fractures which are restimulated using this process.

Stimulation of the injection well can be designed to be high pressure, above the $Sh_{min}$, but low flow, such as less than 15 barrels per minute (BPM). This type of hydraulic fracture process can propagate a fracture with a half-length of 10-100 meters, and in some cases 10-50 m. A typical well drilled to the depths being discussed can have diameter of about 8.5" (21.6 cm), in one example. The circumference of which is about 0.5 m. This means that for a typical production interval of 500 m, such a well will have a surface area of 250 $m^2$. However, a fracture with a half-length of just 30 m has a surface area of 3060 $m^2$, an order of magnitude greater than the surface area of the entire production interval of the well. This means that just one hydraulic fracture is likely to intersect an order of magnitude more natural fractures and veins than the well itself. These factors taken together mean that within each interval hydro-shearing after hydraulic fracturing can expose nearly 10-100 times as many critically stressed naturally fractures to adequate pressure to cause shear failure and fluid infiltration. This pressure can be maintained until the rate of hydro-shearing, as determined by the rate of micro-seismic events recorded by a micro-seismic array, goes below a defined threshold. Production wells can then be drilled into these stimulated natural fractures as mapped by the micro-seismic array.

Figure 5:
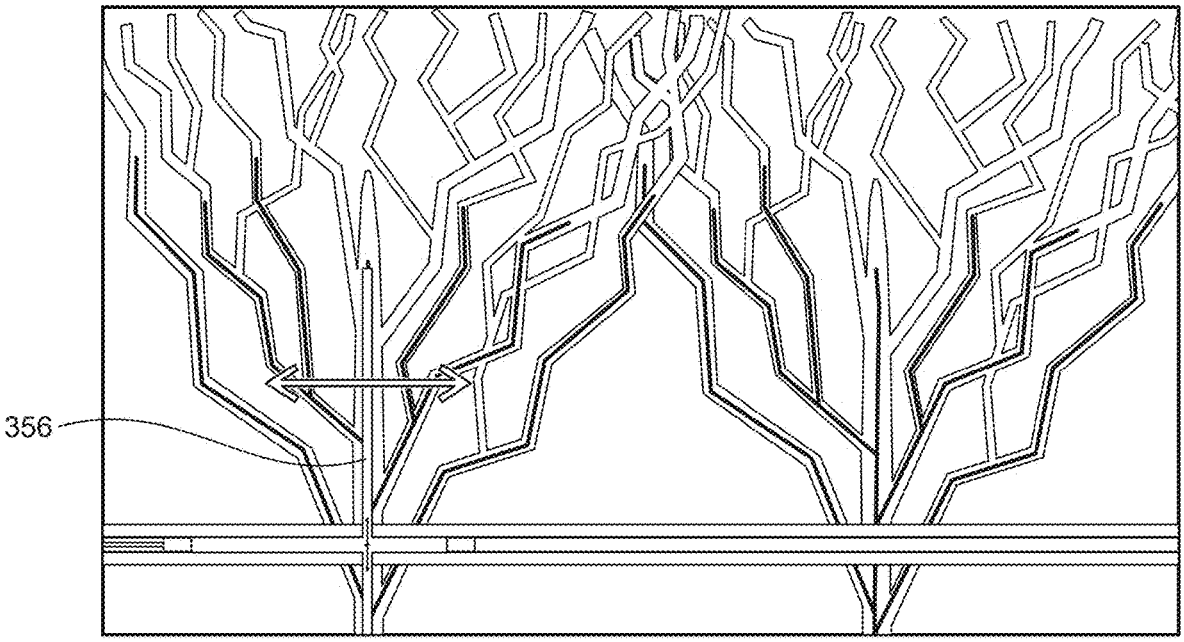
FIG. 5 shows a cross-sectional view of the injection well and hydraulic fracture after fracture growth arrests, in accordance with another example.
Figure 6:
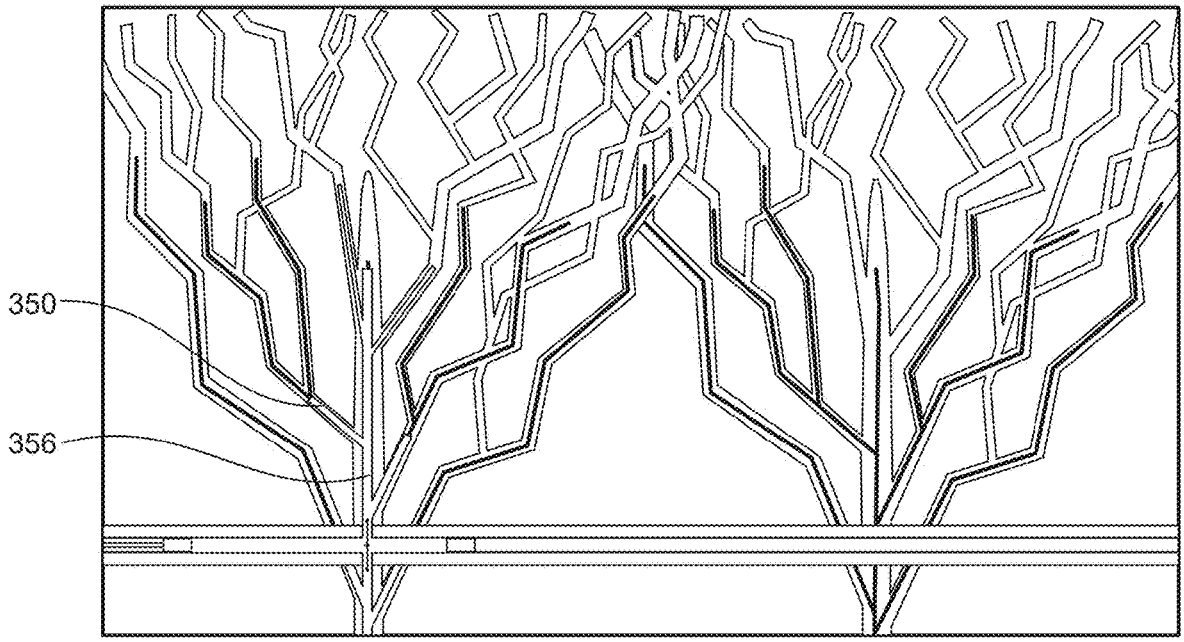
FIG. 6 shows a cross-sectional view of the rock during hydroshearing, in which fluid infiltrates the natural fractures around the hydraulic fracture, in accordance with another example.

Modeling can be performed before stimulation to determine the flow rate necessary to achieve the desired half-length under constant fluid injection. Fracture growth often arrests or ceases under a constant injection rate because of frictional losses in the fracture and because of leak-off, which is a loss of fluid to natural fractures and the pore space within the rock matrix. FIG. 5 illustrates the hydraulic fracture 356 that has stopped growing because the fluid is being lost to pore space in the rock and natural fractures. When fracture growth arrests under a constant injection rate it means substantially all fluid is being taken by natural fractures and the surrounding pore space. This scenario leads to pressure diffusion from the hydraulic fracture into the surrounding rock, which in turn will cause hydroshearing. In some examples, after fracture growth arrests, the injection rate can be held constant for a given period of minutes or hours. During this time, substantially all the fluid can be taken by intersected natural fractures and pore space in the rock, causing pressure diffusion from the hydraulic fracture. FIG. 6 illustrates hydroshearing, in which fluid infiltrates into the natural fractures 350 around the hydraulic fracture. Once the fracture growth becomes arrested, the flow rate can be held constant for a period determined by micro-seismic monitoring. Hydroshearing is the deformation of natural fractures in shear as a response to elevated pressure within the reservoir. When shear failure of natural fractures occurs, it generates a micro-seismic signal that can be picked up by downhole sensors and surface seismic arrays. Using a combination of these devices, micro-seismic events caused by hydroshearing during the period described above can be monitored and the injection rate can be held constant until the rate of micro-seismic events crosses some defined minimum threshold. Once this threshold is reached, the injection can be terminated.

In some cases, the target rate can be constant. However, injection rates can be varied as long as the above conditions are used to obtain the desired hydroshearing. As an example, the half-length can enable communication with the natural fracture network without causing fast paths between wells. The stimulation can be designed so that natural fractures extend beyond the half length of the fracture. One simple way to do this is to model the injection strategy and determine what injection rate corresponds to a given fracture half-length. Holding the injection rate constant is generally a good strategy to achieve the desired goals but is not required. In one example, the injection rate can be within 20% of constant, in other cases within 10%, and in yet other cases within 5%.

Notably, this method causes hydraulic fractures to act like a positive feedback loop once a threshold is passed, which is a pressure above $Sh_{min}$ at the fracture tip. This is because in cases where the pressure is above $Sh_{min}$ at the fracture tip it is more efficient/quicker to accommodate the injected volume by propagating the fracture tip into the rock and enlarging the aperture of the hydraulic fracture. The rate of pressure diffusion into natural fractures is smaller, but also a positive feedback loop. As the pressure diffuses into the natural fracture its aperture enlarges which increases the permeability. This method directs the hydraulic work being done by the pumps at the surface to stimulate and jack open the natural fracture network as opposed to creating an ever larger hydraulic fracture.

In the scenario discussed above the target injection rate is applied instantly. However, this target injection rate may also be achieved through stepwise incremental increases. For example, if the target injection rate is 10 barrels per minute (BPM), then a stepwise injection scenario may reach that target rate though a series of ten 1 BPM steps spaced out by either minutes or hours. The purpose for doing this is to enhance hydroshearing within the targeted volume. Propagating the hydraulic fracture in staggered increments can be useful in some scenarios, such as where natural fracture density is low. Furthermore, instead of complete cessation of pumping, it can also make sense to reduce the injection rate in stepwise increments for these scenarios.

After a period of cessation, which can be defined by the rate of seismicity reaching some minimum threshold, the injection rate can be brought back to at or near the original maximum injection rate. This can be done instantly or in stepwise fashion. Doing this can reinflate the hydraulic fracture to the original half-length. The purpose of ceasing or reducing injection and then resuming or increasing injection, known henceforth as cyclic stimulation, is to increase the probability of shearing sealed fractures. Shearing of natural fractures breaks apart and grinds alteration minerals contained within them, including sulfides. This grinding action within the natural fractures breaks apart the sulfide minerals into smaller particle sizes in addition to liberating them from other material. Therefore, maximizing the amount of shearing within the reservoir can greatly increase the exposed surface area of sulfides in the reservoir and enable more efficacious leaching of copper or other metals. The number of cycles used to achieve these results can generally vary from one to ten. Cyclic stimulation can be performed on one or more perforation or jetted zones at a time.

Cyclic stimulation can involve a prolonged period where the injection pressure oscillates above and below the closure pressure ($Sh_{min}$) of the hydraulic fractures. Cyclic fracturing can typically be done on one fracture at a time, but the process is amenable to multiple fractures as well. The pressure oscillation can occur in a small number of large pressure steps (up and down, +/− greater than 1000 psi (6.9 MPa)) or a series of many smaller pressure steps (going up in pressure in 50-500 psi (345 kPa to 3.5 MPa) increments, and then going down in pressure using the same increments). The purpose of oscillating above and below the closure pressure of the hydraulic fracture is to continually change the direction and intensity of stress in the target zone. Jacking the hydraulic fractures open can put compressional stress on the rock normal to the fracture plane, changing the orientation of stress in the rock. Then when the hydraulic fracture is allowed to close, the stress orientation will change back to near where it was before fracture opening. By continually changing sigma 2 ($\sigma 2$) and sigma 3 ($\sigma 3$) stress directions, a wider distribution of fracture orientations can be allowed to fail in shear. This is because fractures whose dip direction aligns with sigma 3 stress direction have the highest likelihood of slipping. By continually rotating the direction of sigma 3 proximal to the inflated fracture, a wide variety of fractures will be allowed to slip. Furthermore, opening and closing the hydraulic fracture repeatedly can reactivate stimulated fractures, causing increased grinding within the fracture. This cyclic loading can put incredible strain on alteration minerals within the fracture, causing the alteration minerals to break as they become brecciated. This brecciation is helped by the fact that alteration minerals within fractures tend to have many microfractures resulting from previous shearing events and/or current strain on the fracture. This brecciation, grinding, of the alteration minerals is used to increase the surface area of the minerals in the fractures, and may in some cases increase the permeability of the natural fractures as well.

In certain examples, cyclic stimulation (also referred to as cyclic jacking) can include alternating between a first injection pressure and a second injection pressure. In some cases, the first injection pressure can be above the $Sh_{min}$ and the second injection pressure can be below the first injection pressure. In certain examples, the second injection pressure can be below $Sh_{min}$, or about equal to $Sh_{min}$, or greater than $Sh_{min}$. In further examples, the first pressure can be greater than the second pressure by an amount from about 100 psi (690 kPa) to about 2,000 psi (13.8 MPa), or from about 100 psi (690 kPa) to about 1,000 psi (6.9 MPa). In still further examples, the first pressure can be from about 100 psi (690 kPa) to about 2,000 psi (13.8 MPa) above $Sh_{min}$, and the second pressure can be within about 100 psi (690 kPa) to about 1,000 psi (6.9 MPa) of $Sh_{min}$.

Figure 7:
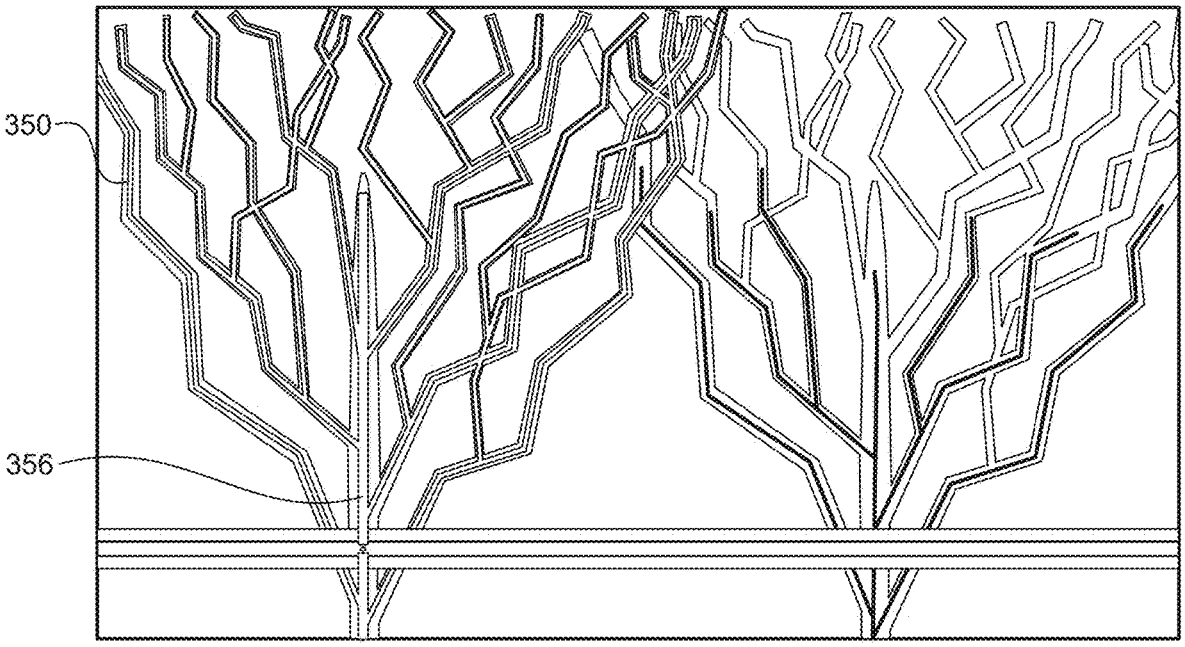
FIG. 7 shows a cross-sectional view of the rock after additional cycles of injecting at above $Sh_{min}$ into the targeted zone until the hydrothermal system is fully stimulated in accordance with one example.
Figure 8A:
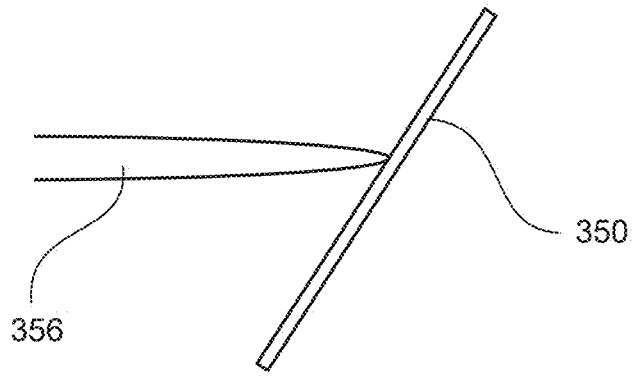
FIGS. 8A-8C illustrate a hydraulic fracture cutting across natural fractures without causing stimulation of the natural fracture.
Figure 8B:
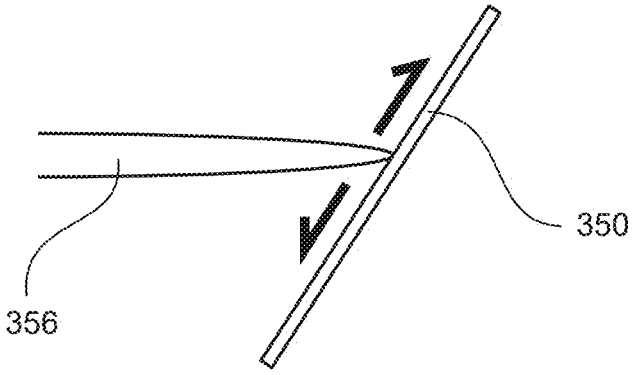
Figure 8C:
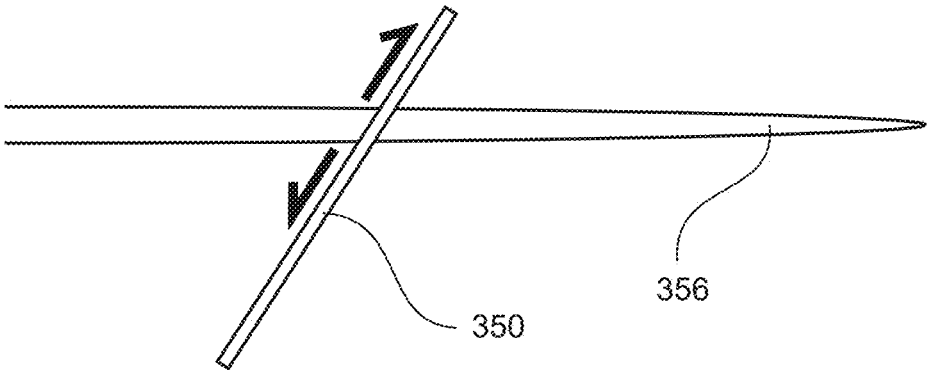

FIG. 7 shows the natural fractures 350 where more of the natural fractures have been stimulated through the hydroshearing process described above. Repeatedly injecting fluid at a pressure above $Sh_{min}$ can result in the natural fracture system being fully stimulated. On the last cycle, and while pumping at the higher rate, proppant can be emplaced into the stimulated reservoir. This can provide a reopened and permeable hydrothermal system that contains sulfides. FIG. 8A illustrates an example of a hydraulic fracture 356 propagating until the tip of the hydraulic fracture meets a natural fracture. As shown in FIG. 8B, some of the fluid can be lost to the natural fracture. The rate of fluid loss can be governed by the permeability of the natural fracture. If the permeability of the natural fracture is low, the rate of fluid loss and pressure diffusion will be small. FIG. 8C shows the hydraulic fracture propagating through the natural fracture. This can occur if the injection rate is sufficiently high and the pressure diffusion into the natural fracture will be too slow to cause stimulation of the natural fracture before the hydraulic fracture tip cuts across the natural fracture.

Figure 9A:
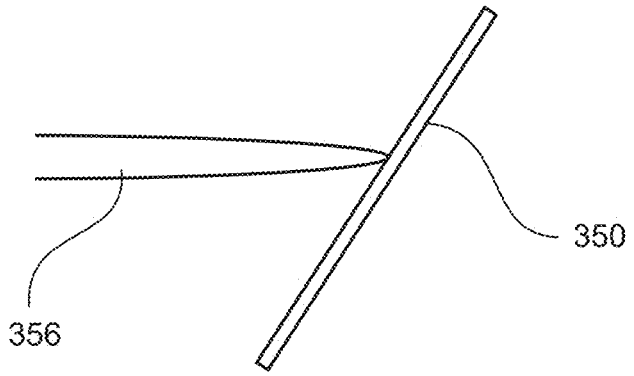
FIGS. 9A-9C illustrate a hydraulic fracture causing natural fracture stimulation and branching in accordance with one example.
Figure 9B:
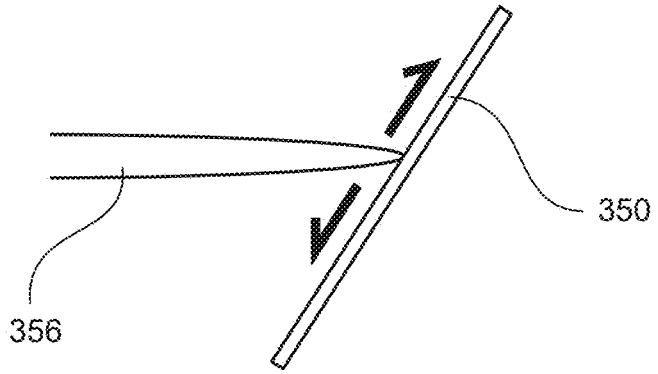
Figure 9C:
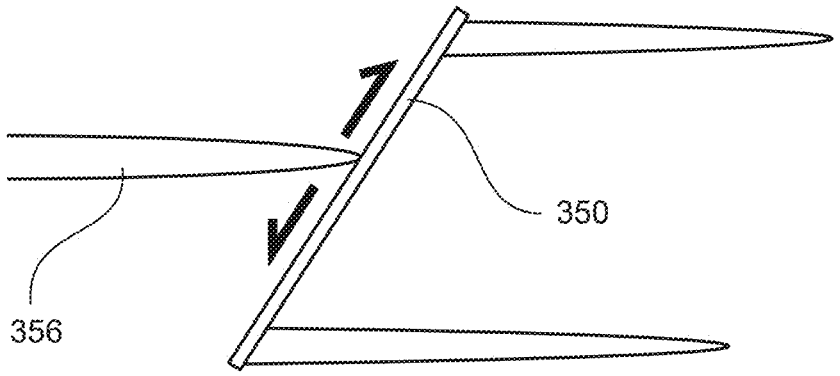

FIG. 9A shows another example of a hydraulic fracture 356 propagating until it meets a natural fracture 350. FIG. 9B shows that, again, some fluid is lost into the natural fracture. FIG. 9C shows that, in this example, the injection rate is slow enough and/or the pressure diffusion into the natural fracture is high enough to cause the natural fracture to be stimulated. This can cause the natural fracture to begin propagating from the tips of the natural fracture, and thus the original hydraulic fracture branches into two fractures. When this is repeated with multiple natural fractures, many branches can form. Branching can be used effectively to connect a greater number of natural fractures within a given rock volume.

Figure 10A:
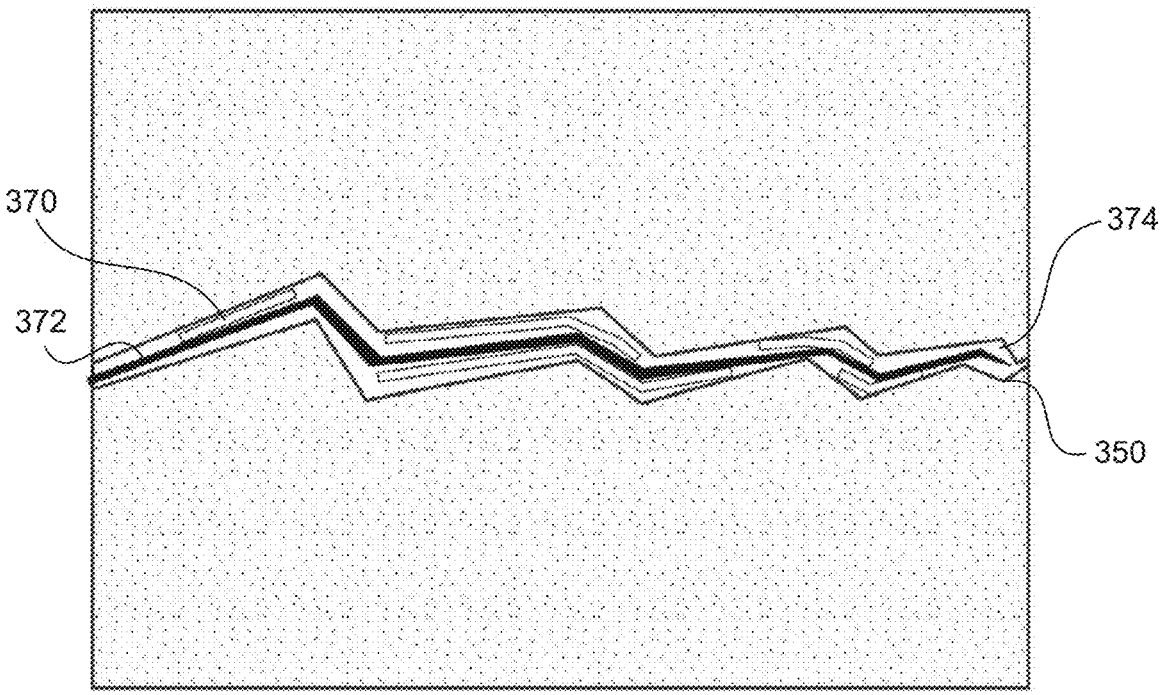
FIGS. 10A-10B illustrate a chemical treatment used to dissolve the internal layer of alteration minerals within a set of natural fractures in accordance with another example.
Figure 10B:
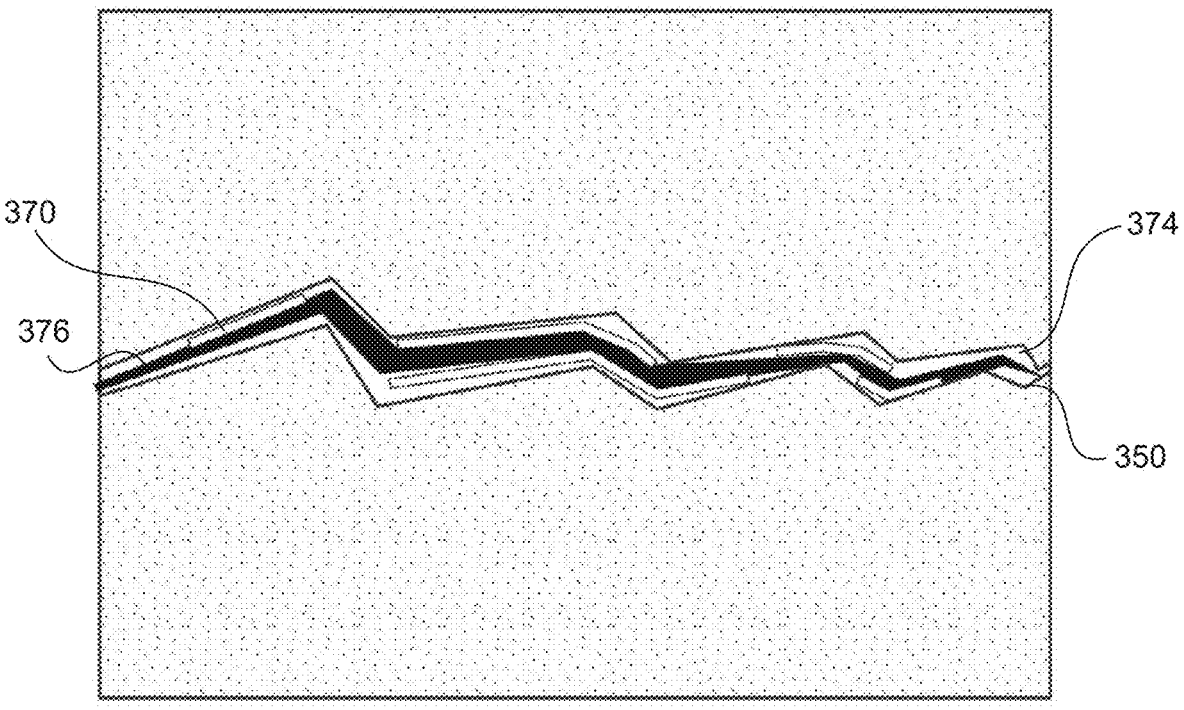
Figure 11A:
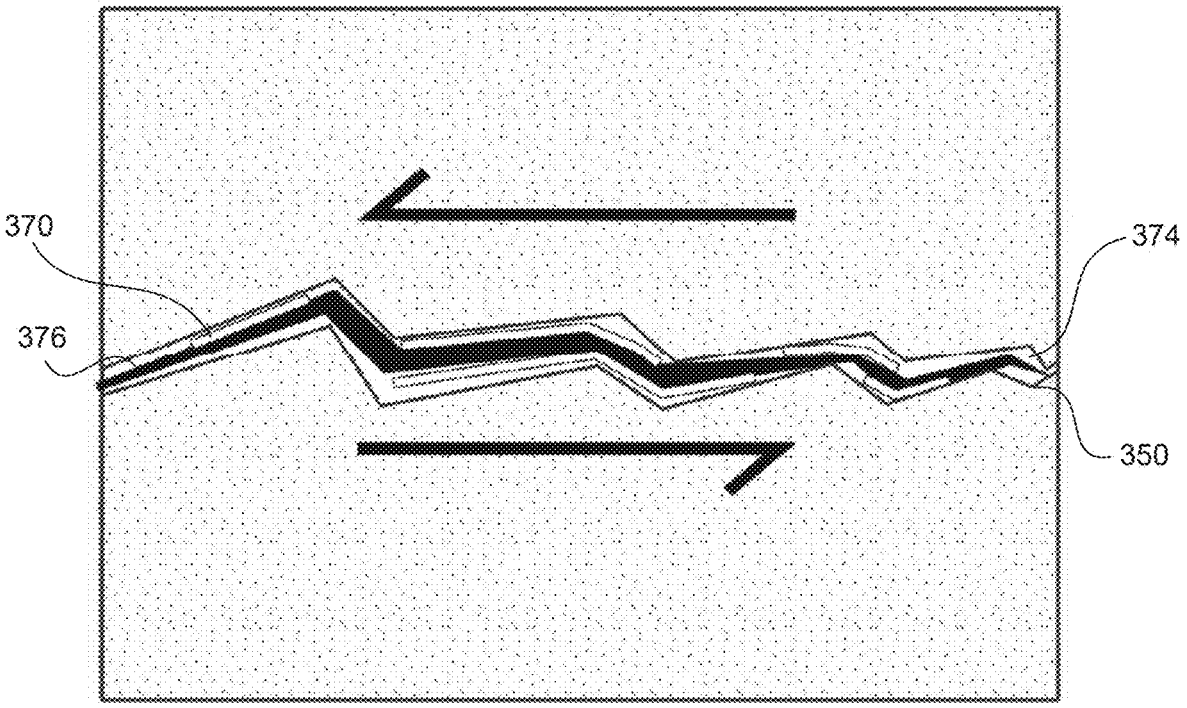
FIGS. 11A-11B illustrate dissolution of the internal layer of alteration minerals resulting in shear/slip along the fracture in accordance with one example.
Figure 11B:
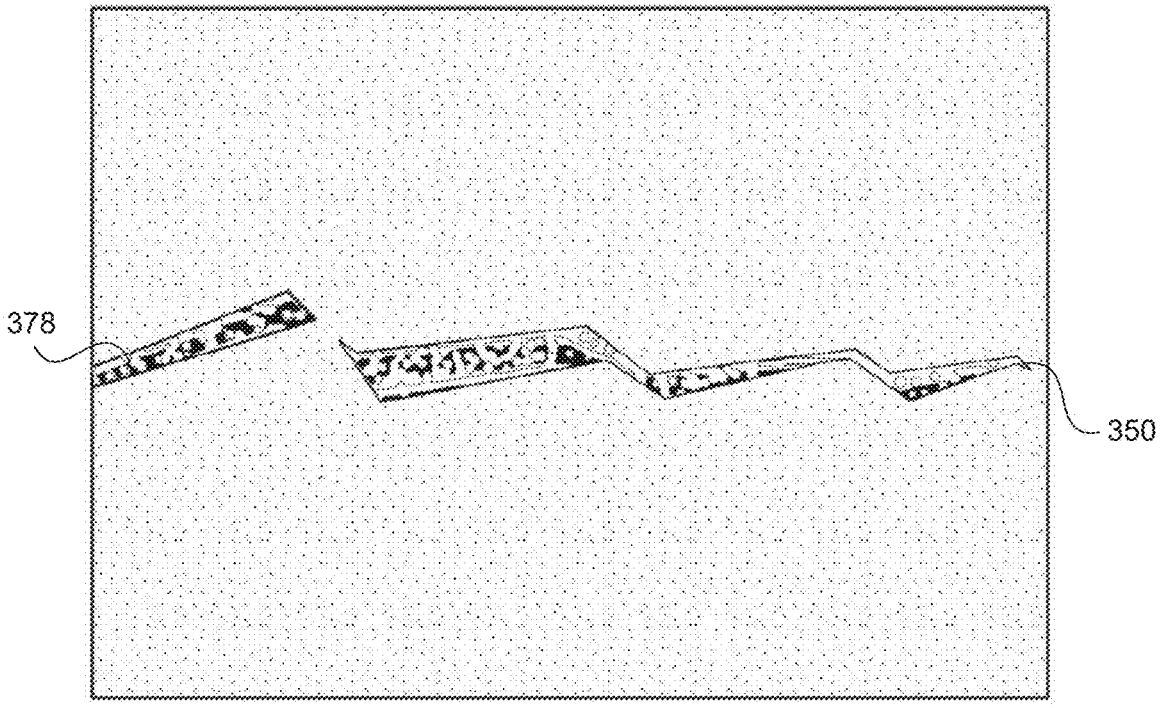

Chemical treatments may be used in one or more of the stimulation cycles. In such cases the injected fluid can be treated using a weak acid or alkaline solution. The purpose of such action is to dissolve, or partially dissolve, alteration minerals within natural fractures contained within the stimulated rock volume. FIG. 10A shows a natural fracture 350 containing sulfides 370, chlorite 372, and silica 374 as examples of alteration minerals that may be present. FIG. 10B shows the natural fracture filled with treatment fluid 376 that dissolves the chlorite. As alteration minerals dissolve, the friction holding the fracture together will lessen. This reduction in friction along the fracture can enable more natural fractures within the targeted rock volume to fail in shear, further increasing access to sulfides to in situ leaching. The specific chemicals to be used and the sequence in which they will be used can be informed by core analysis. Alteration minerals within fractures are often deposited in layers. Some alteration minerals react with acids while others react with alkaline solutions. Using core analysis, the layers of alteration minerals can be determined and the alteration minerals overlaying sulfide can be targeted for dissolution. For example, in cases where acids are used, a weak buffering acid (acetic acid, citric acid, etc.) can be used to limit the oxidation of sulfides encountered by the treatment fluid. In the case of silica, an alkaline solution can be used, e.g. NaOH or ammonia. Using a base as a chemical treatment takes advantage of the increased solubility of silica at high temperature and pH. For example, silica in a solution with a pH of 10 and a temperature of 60° C. has a dissolution rate 5 orders of magnitude larger than it does at room temperature water. Even at these elevated rates, the total silica dissolved is small (on the order of 0.5-5 grams of silica dissolved for each square meter of exposed surface area during a full hydro shearing stimulation). Therefore, this technique is mainly used to enhance permeable pathways into veins, lowering cohesion and allowing for slip, or for removing thin silica layers. The rate of silica dissolution can also be controlled by adjusting the temperature and pH of the treatment fluid during the cyclic fracturing. FIG. 11A shows a natural fracture filled with treatment fluid, where the treatment causes the fracture to slip back and forth as indicated by arrows. FIG. 11B shows the fracture containing rubblized alteration minerals 378 that can be generated by the slipping motion grinding the alteration minerals in the fracture. This slip can result in the destruction of alteration minerals within the fracture, leading to a permanently enhanced fracture permeability and to a much greater surface area of sulfides with which the in situ leaching solution reacts Proppant can be emplaced at the last cycle of the cyclic stimulation. This can greatly reduce operational costs by lowering the pumping pressure required to get chemical treatment out into the natural fracture network. If proppant were not emplaced in the injection well, then pump pressure would have to be greater than the closure pressure of the hydraulic fracture for there to be economic levels of flow. Light-weight non-reactive proppant can be useful. Such proppants include resin/epoxy-based proppants and resin coated proppants. Sand may be suitable as well but has a relatively high density. Initial fluid injection into the fracture can use a small proppant size (e.g. 60-100 mesh) and after some period the proppant size can increase (e.g. 30-70 mesh). By reducing the size and density of proppant, the settling time is also reduced, meaning the proppant can be transported much farther out into the reservoir with increased uniformity of distribution.

After this stimulation procedure is complete, it can be repeated until all (or at least substantially all) jetted or perforated zones within a targeted interval of the injection well have undergone the stimulation procedure described above.

Figure 12:
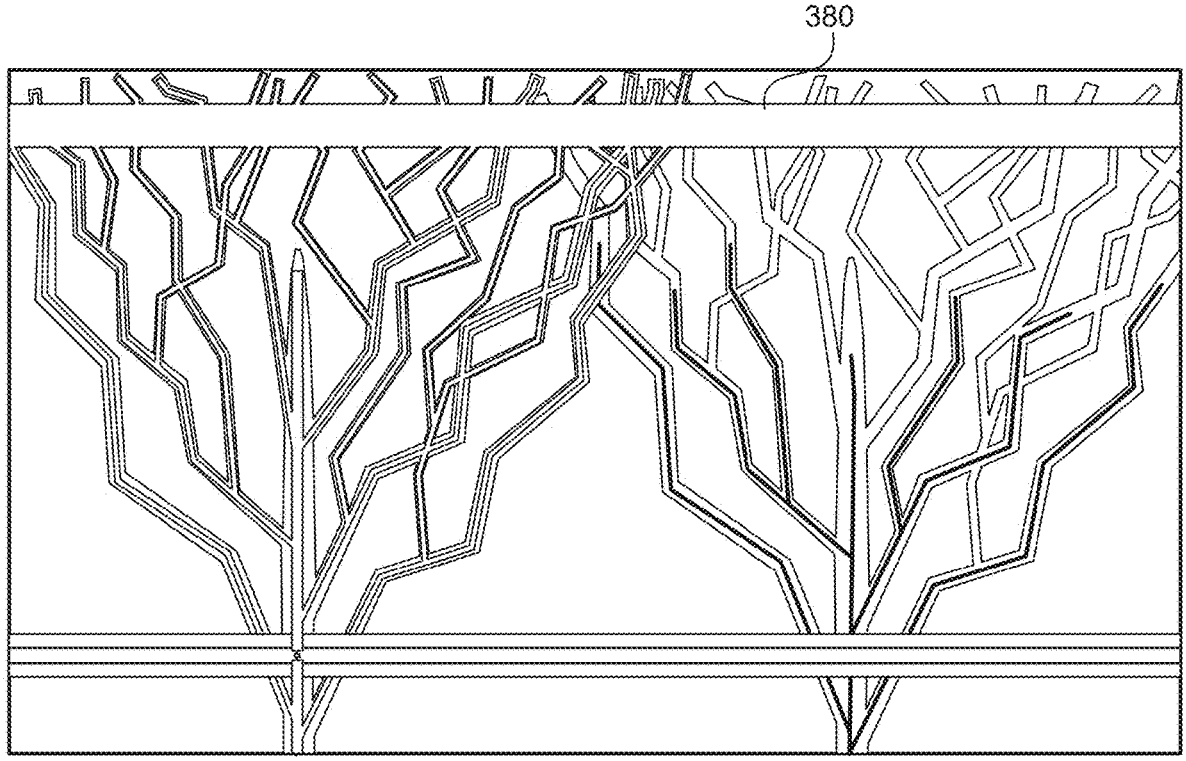
FIG. 12 shows a cross-sectional view of a production well drilled at the edge of the stimulated reservoir in accordance with yet another example.

Once the targeted well interval within the injection well has been fully stimulated, the recorded seismic data can be interpreted to provide a 3D model of the generated hydraulic fractures and stimulated natural fracture networks. This can be used to determine the trajectories of a set of production wells. As an example, the production wells can target the edge of the seismic cloud, or the farthest extent of the stimulated natural fracture network. One or more production wells can be located at roughly equal angles from one another at roughly equal radial distances, where the origin point is where the injection well intersects a vertical plane perpendicular to the direction of the well trajectory. FIG. 12 shows an example production well 380 formed near the edge of the stimulated natural fractures that were stimulated through the injection well as described above.

Figure 13:
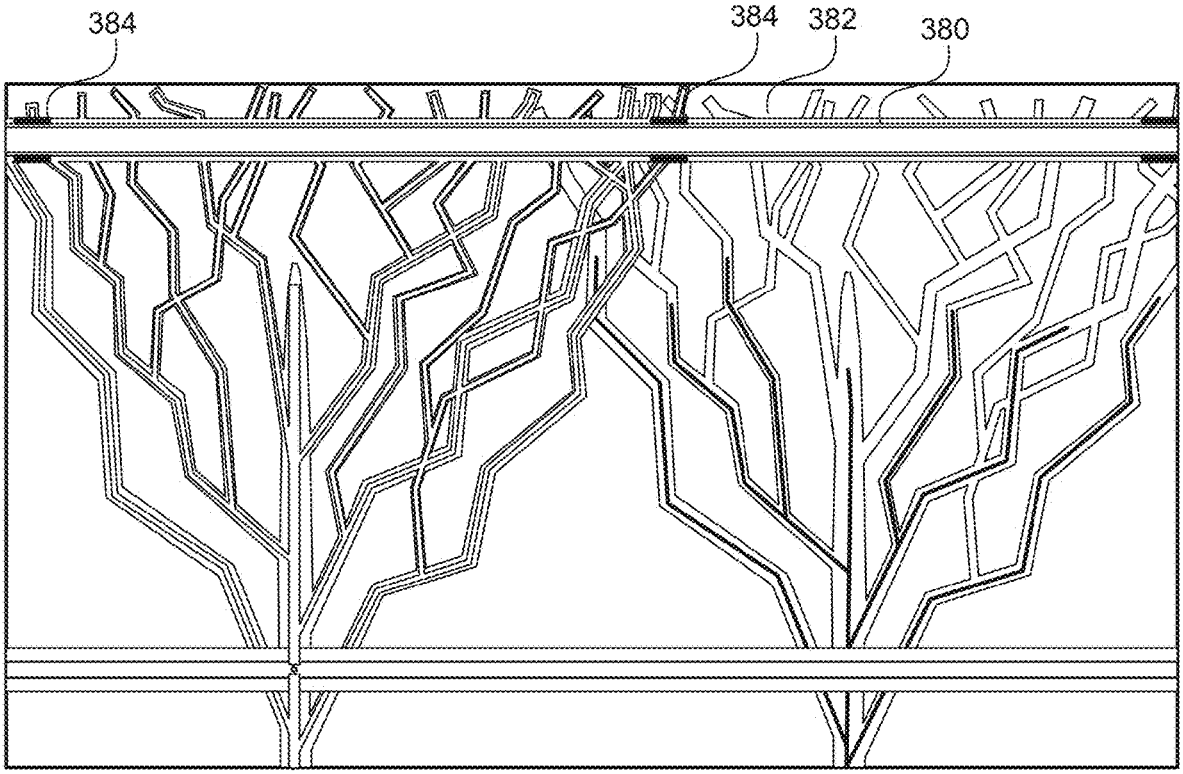
FIG. 13 shows a cross-sectional view in which the production well is completed using a liner and external casing packers (ECPs) in accordance with one example.

The production wells can be completed differently than the injection well. Instead of being cased and cemented through the entire production interval, the production interval of the production well can be completed using a blank liner and a series of external casing packers. FIG. 13 shows an example of the production well 380 with a blank liner 382 and external packers 384. This completion method allows for predefined segments of open wellbore to be mechanically isolated. In both the injection wells and production wells, one predefined interval can be stimulated and produced at a time. In one example, all the volume contained by a pod can be stimulated in segments. In such cases, one interval can be stimulated and produced and then the next interval can be stimulated and produced. External casing packers or ECPs can be set 5-150 meters apart depending on the resource. The spacing can be determined by analysis of lithology, seismic data, pressure response in the injection well, and well logging, such as resistivity, gamma ray, image logs, density logs, and downhole temperature and pressure measurements. A mechanically isolated section of open wellbore is an important feature because it allows production from natural fractures. The sulfide ore is housed in natural fractures; therefore, a system which can be designed to transport lixiviant preferentially through the natural fracture network and not simply through hydraulic fractures would be beneficial. If the production well were cased and cemented, the stimulated natural fractures intersected by the production well would become filled with cement. In such cases, fractures can be hydraulically generated to access the previously stimulated reservoir. The new hydraulic fractures emanating from the production well would cause a short circuit and fluid flow would be concentrated along hydraulic fractures in the injection and production well, bypassing all the sulfide ore found in the natural fracture network. The other reason for mechanically isolating target segments within the well is to increase the efficiency of the leaching process. The process can target fracture networks which contain sulfide ore. It also aims to limit the size of the natural fracture network being treated at any given time. Limiting treatment to small portions of the rock volume at a given time will provide a higher overall recovery factor from the ore body.

Figure 14:
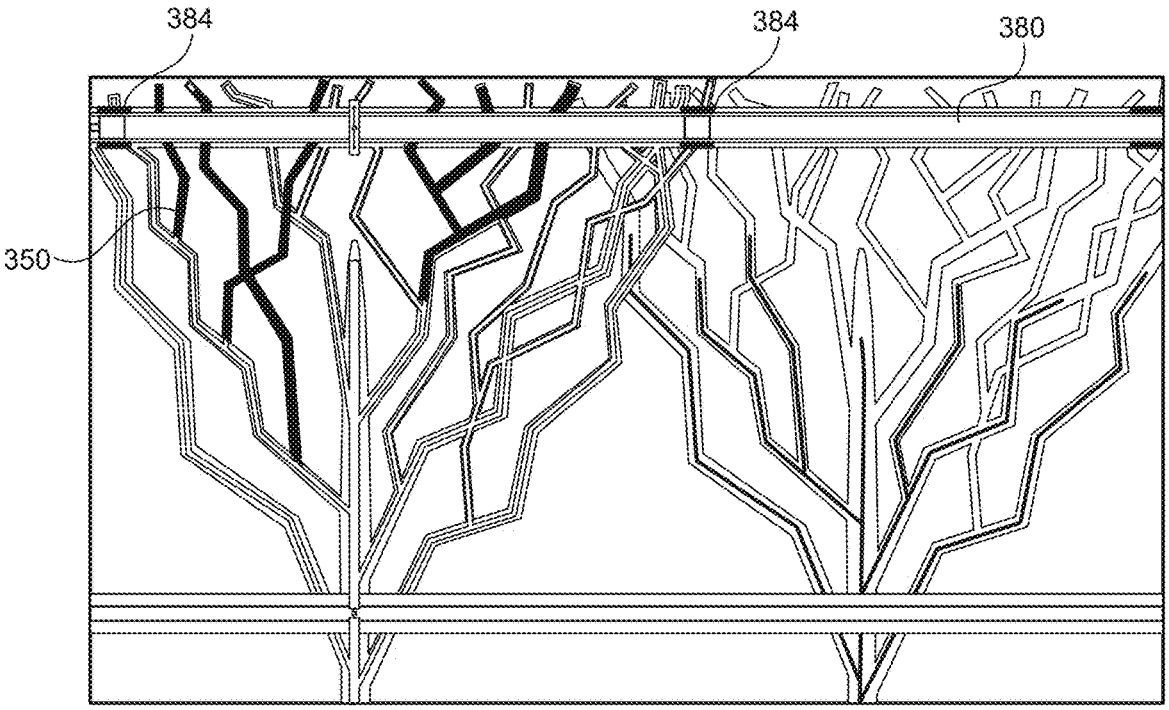
FIG. 14 shows a cross-sectional view in which the section of production well which has intersected the stimulated reservoir is jetted/perforated in accordance with another example.
Figure 15:
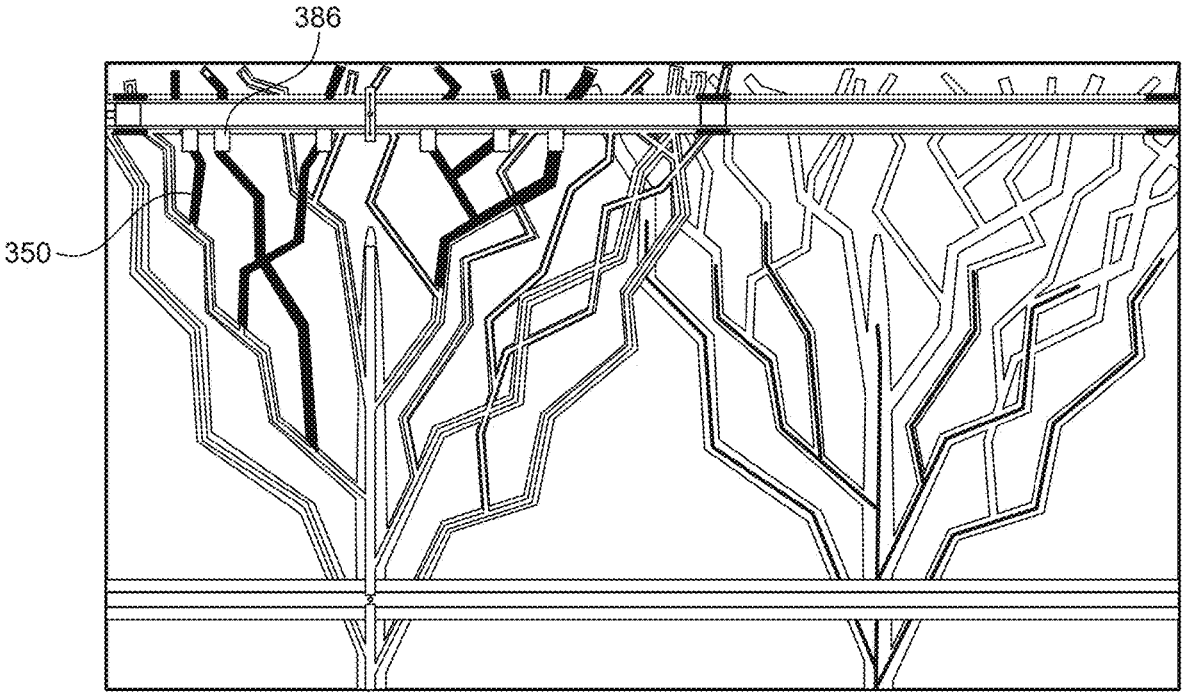
FIG. 15 shows a cross-sectional view in which a degradable diverter is injected in the production well to temporarily seal stimulated fractures.
Figure 16:
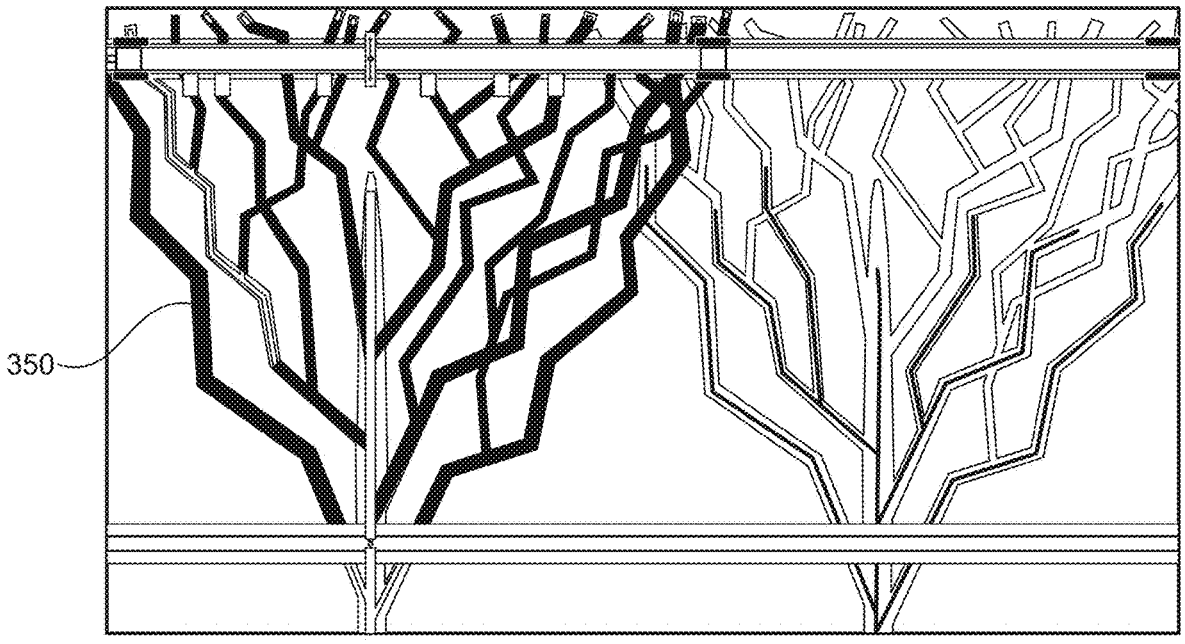
FIG. 16 shows a cross-sectional view in which new natural fractures are stimulated by pumping fluid into the production well.
Figure 17:
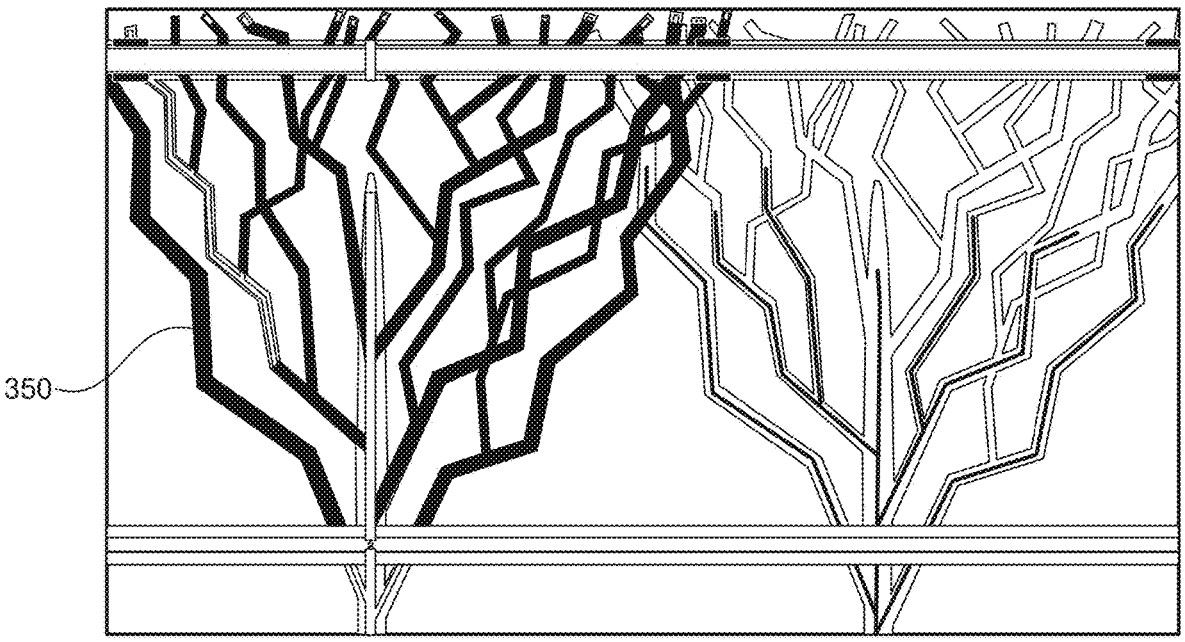
FIG. 17 shows a cross-sectional view in which the diverter has degraded to leave a permeable reservoir that allows for efficient in situ leaching of sulfides within the reservoir.

The first phase of stimulation for the production well involves jetting or perforating a targeted interval or intervals between two ECPs. FIG. 14 shows the stimulation of one interval between two external packers 384, resulting in stimulation of natural fractures 350 that intersect with the production well. Packers or plugs can be used to isolate a section within the liner at one of the perforated/jetted zones. After this is completed, injection pumping pressure can be brought up to $Sh_{min}$, or slightly above. This can cause stimulation and inflation of the most permeable natural fractures within the targeted section of the wellbore. Proppant can then be pumped into the target zone. After proppant is emplaced, the pressure can be reduced to 5-40% below $Sh_{min}$. While pumping below $Sh_{min}$, slick water (fracking fluid containing surfactants) can be used to increase the pressure diffusion into natural fractures. This can then be followed by pumping a slug of thermally degradable diverter, likely polylactic acid (PLA) or similar type of polymer, or a salt such as rock salt. This can clog the pores of the proppant pack and reduce the permeability of previously stimulated natural fractures. FIG. 15 shows an example of a thermally degradable diverter 386 placed in the previously stimulated natural fractures 350. The previously stimulated natural fractures filled with proppant, and then sealed using diverter, will now have lower permeability than other natural fractures in the well. The pressure can then be brought back up to near $Sh_{min}$ to stimulate a new set of fractures and proppant can be emplaced into these new stimulated fractures. FIG. 16 shows an example of stimulating new natural fractures in this way. These steps can then be repeated until all, or substantially all, natural fractures in the target interval or intervals have been stimulated. FIG. 17 shows an example when substantially all the natural fractures have been stimulated and the thermally degradable diverter has degraded so that all the stimulated natural fractures are open. This can allow for large pumping rates in the production well during operations, which can create a low-pressure zone within the natural fracture reservoir. Without emplacing proppant within the intersected natural fractures, this low-pressure zone would reduce the permeability of the natural fractures and limit production. Creating a zone of low-pressure during operations allows for maintaining a high recovery factor as it encourages fluid to be produced from the entire natural fracture network and not just a limited set of high permeable pathways. If enough stimulated natural fractures are intersected by the well, then leak off will be sufficient to prevent hydraulic fracturing during the cyclic fracturing process, if there are an insufficient number of intersected fractures then hydraulic fracturing is likely to occur during this process. The main purpose of stimulating the production wells is to increase near well permeability without allowing flow to by-pass natural fractures, which is where the sulfide minerals are located. Therefore, the goal of production well stimulation is to enhance the permeability of the intersected natural fractures, or if that is insufficient, create very small-scale hydraulic fractures which enhance permeability. In some cases, where fracture density is very low, the production well may need to be cased, cemented, and stimulated in the same manner as the injection well.

This stimulation procedure can be guided by obtaining certain information before the well is drilled. Such inputs can include analysis of the intensity and direction of $Sh_{min}$ in the subsurface using a Diagnostic Fracture Injection Test (DFIT). This can be used to determine an optimal well trajectory and help determine pumping requirements for the planned stimulation. Additionally, once the well is fully drilled through the ore body, core, cuttings, and image logs can be used to characterize the population of natural fractures. This can be used to determine an optimal hydro-shearing pressure and the chemical agents that can be used, as well as the sequence in which these chemicals can be used. Lastly, injection tests can be run to determine the baseline near-wellbore and far-field permeability. This can help determine the amount of hydraulic fractures that can be desirable and the specific techniques used (such as hydraulic fracturing between existing sets of hydraulic fractures). In areas where significant natural permeability exists, hydraulic fractures can be placed farther apart in the production interval. In cases where the natural permeability is limited, hydraulic fractures can be placed more closely together. This can be done to make sure the fluid pressure transient is more equally distributed through the rock volume and treatment fluid is reaching more sulfide material. In cases where hydraulic fractures are closely spaced, all fractures within an interval can be cyclically fractured before emplacing proppant. This can be done to avoid adversely changing the near-wellbore stress and causing non-planar fractures. The proppant/diverter slug technique discussed for production wells can be used in such cases to ensure proppant placement in all hydraulic fractures within a given interval.

Once both injection and production wells have been stimulated, leaching of the rock can begin. This can involve injection of a treatment fluid containing an alkaline or acidic lixiviant system in conjunction with some form of oxidant (e.g. oxygen, perchlorate, potassium permanganate, or nitric acid). The lixiviant system can employ glycine, ammonia, citric acid, chlorine, or other complexing agents, to selectively complex with copper. The pH and ionic strength of the treatment fluid can be tuned so that the glycinate and ammonia copper complexes generated by the leaching process will be soluble, allowing for transport within the reservoir and for the copper laden fluid to be pumped to the surface. An alkaline lixiviant system limits the reaction of the treatment fluid with other minerals in the subsurface. This means that the system can work more efficiently than an acid-based system and treatment chemicals can be better recovered and reused at the surface, which has large cost implications. However, in some cases, such as when there is a large concentration of chalcopyrite within the fractured ore body, an acid-based system may be more useful. In these cases, the acid-based lixiviant can greatly speed up copper extraction over other solutions. In some examples, the alkaline lixiviant system can have a pH from greater than 7.0 to about 12.0, or from greater than 7.0 to about 11.0, or from greater than 7.0 to about 10.0, or from greater than 7.0 to about 9.0, or from greater than 7.0 to about 8.0. In some examples, the acidic lixiviant system can have a pH from less than 7.0 to about 1.0, or from less than 7.0 to about 2.0, or from less than 7.0 to about 3.0, or from less than 7.0 to about 4.0, or from less than 7.0 to about 5.0.

Mining operations can employ a push and pull method of pumping to allow treatment fluid to be in contact with most of the stimulated reservoir. This can be done by simply alternating injection and production. While the injection well is pumped with fluid at some defined max rate (under $Sh_{min}$), the production well can either not be pumped or pumped at a low rate. Following this operation, the production well can be pumped at some defined maximum rate (corresponding to a minimum allowable head above the pump) while the injection rate is pumped at a lower rate or not pumped at all. This type of operation has the added benefit of allowing for continual shearing of natural fractures in the reservoir. This can be done by bringing the injection pressure just under $Sh_{min}$. Continual shear stimulation of the natural fractures in the reservoir can expose more virgin rock and sulfides to the treatment fluid, increasing the recovery factor.

While the flowcharts presented for this technology may imply a specific order of execution, the order of execution may differ from what is illustrated. For example, the order of two more blocks may be rearranged relative to the order shown. Further, two or more blocks shown in succession may be executed in parallel or with partial parallelization. In some configurations, one or more blocks shown in the flow chart may be omitted or skipped. Any number of counters, state variables, warning semaphores, or messages might be added to the logical flow for purposes of enhanced utility, accounting, performance, measurement, troubleshooting or for similar reasons.

Reference was made to the examples illustrated in the drawings and specific language was used herein to describe the same. It will nevertheless be understood that no limitation of the scope of the technology is thereby intended. Alterations and further modifications of the features illustrated herein and additional applications of the examples as illustrated herein are to be considered within the scope of the description.

Furthermore, the described features, structures, or characteristics may be combined in any suitable manner in one or more examples. In the preceding description, numerous specific details were provided, such as examples of various configurations to provide a thorough understanding of examples of the described technology. It will be recognized, however, that the technology may be practiced without one or more of the specific details, or with other methods, components, devices, etc. In other instances, well-known structures or operations are not shown or described in detail to avoid obscuring aspects of the technology.

Although the subject matter has been described in language specific to structural features and/or operations, it is to be understood that the subject matter defined in the appended claims is not necessarily limited to the specific features and operations described above. Rather, the specific features and acts described above are disclosed as example forms of implementing the claims. Numerous modifications and alternative arrangements may be devised without departing from the spirit and scope of the described technology.

EXAMPLES

The Technology Described Herein can Include the Following Enumerated Examples:

Example 1: A method of leaching copper from a porphyry copper ore body within a subsurface volume of rock comprising:

forming an injection well adjacent to or within the porphyry copper ore body;

forming at least one lateral injection hole extending from the injection well;

stimulating the at least one lateral injection hole through the injection well under a hybrid stimulation phase, wherein the hybrid stimulation phase includes:

a first hydraulic fracturing phase at an injection rate and a pressure which exceeds a minimum principal horizontal stress ($Sh_{min}$) such that a first set of hydraulic fractures are formed which extend from the at least one lateral injection hole to intersect with a first set of natural fractures, a first hydroshearing phase, where the injection rate is held at a target rate until hydraulic fracture growth is allowed to arrest, and leak-off into natural fractures becomes a dominant pressure sink, mapping the first set of natural fractures during stimulation using a micro-seismic array to form a stimulated natural fracture map, and emplacing a proppant in the first set of hydraulic fractures and the first set of natural fractures to form a first set of stimulated propped hydraulic fractures and a first set of stimulated propped natural fractures;

drilling at least one production well adjacent to or within the first set of stimulated propped natural fractures using the stimulated natural fracture map;

completing at least one production well using a hybrid open hole completion where a production interval is completed using a blank liner and external casing packers;

stimulating the at least one production well under a second hydroshearing phase, where an injection pressure is held near $Sh_{min}$, such that a portion of the first set of natural fractures intersected by the production well are preferentially stimulated;

emplacing a proppant in the natural fractures intersected by the production well to form a stimulated reservoir including a set of stimulated propped natural fractures; and leaching copper from the porphyry copper ore body by contacting a leaching fluid with the porphyry copper ore body via the stimulated reservoir to form a copper-laden solution.

Example 2: The method of any of examples 1-28, wherein the forming the injection well includes drilling the injection well, and introducing a casing and a lining within the injection well.

Example 3: The method of any of examples 1-28, wherein forming the at least one lateral injection hole is performed using hydra-jetting or a perforation gun.

Example 4: The method of any of examples 1-28, wherein the at least one lateral injection hole is formed in a direction of the $Sh_{min}$ toward the porphyry copper ore body.

Example 5: The method of any of examples 1-28, wherein the injection well is from 150 to 4000 m in depth, and the at least one lateral injection hole includes 1 to 100 perforation or jetted zones which are spaced apart from 5 to 50 m.

Example 6: The method of any of examples 1-28, wherein the hybrid stimulation phase further comprises introducing a chemical agent, wherein the chemical agent preferentially removes alteration minerals within the porphyry copper ore body.

Example 7: The method of any of examples 1-28, wherein the chemical agent has a pH below 7.0 which preferentially dissolves chlorite and clays as alteration minerals.

Example 8: The method of any of examples 1-28, wherein the chemical agent is alkaline.

Example 9: The method of any of examples 1-28, wherein the introducing a chemical agent includes at least two treatment stages which include a first chemical treatment which targets alteration mineral including silica, and a second chemical treatment which targets clays, quartz and sulfides.

Example 10: The method of any of examples 1-28, wherein the first hydroshearing phase comprises holding the target injection rate for a time determined by monitoring for a threshold decrease in micro-seismic events recorded by the micro-seismic array.

Example 11: The method of any of examples 1-28, wherein the first hydroshearing phase comprises injecting a surfactant to increase pressure diffusion into the first set of natural fractures.

Example 12: The method of any of examples 1-28, wherein the target rate is constant throughout the first hydroshearing phase.

Example 13: The method of any of examples 1-28, wherein the hybrid stimulation phase further comprises cyclically jacking one or more hydraulic fractures by alternating between a first injection pressure above the $Sh_{min}$ and a second injection pressure below the first injection pressure, such that a stress orientation of σ2 and σ3 cyclically vary in a localized volume of rock proximal to the one or more hydraulic fractures so as to increase alignment of the stress orientation with the first set of stimulated natural fractures and increase hydroshearing in these natural fractures.

Example 14: The method of any of examples 1-28, wherein the second injection pressure is below the $Sh_{min}$.

Example 15: The method of any of examples 1-28, wherein the first injection pressure is 100 to 1000 psi (690 kPa to 6.9 MPa) above $Sh_{min}$ and the second injection pressure is 100 to 1000 psi (690 kPa to 6.9 MPa) below $Sh_{min}$.

Example 16: The method of any of examples 1-28, wherein the injection pressure is cycled by stepwise increasing the injection pressure above the $Sh_{min}$ to the first injection pressure, and then stepwise decreasing the injection pressure to the second injection pressure.

Example 17: The method of any of examples 1-28, wherein the stepwise pressure increase of the injection pressure is in increments of from 50 to 500 (345 kPa to 3.5 MPa) psi.

Example 18: The method of any of examples 1-28, wherein the at least one production well includes three to five production wells.

Example 19: The method of any of examples 1-28, wherein the three to five production wells are stimulated and produced in series.

Example 20: The method of any of examples 1-28, wherein the production wells are distributed around the injection well in a hub and spoke configuration, and are about equally distanced from the injection well.

Example 21: The method of any of examples 1-28, wherein the production wells are completed within the production interval using the blank liner and external casing packers.

Example 22: The method of any of examples 1-28, further comprising stimulating the at least one production well under a second hydraulic fracturing phase to form a second set of hydraulic fractures which intersect at least one of the first set of natural fractures, and which is insufficient to connect the second set of hydraulic fractures with the first set of hydraulic fractures.

Example 23: The method of any of examples 1-28, further comprising introducing a diverter material to at least partially block a portion of the first set of natural fractures which are intersected by the at least one production well prior to stimulating the at least one production well under the second hydroshearing phase.

Example 24: The method of any of examples 1-28, wherein the diverter material is a degradable diverter material.

Example 25: The method of any of examples 1-28, wherein the leaching the copper includes introducing glycine which complexes with copper.

Example 26: The method of any of examples 1-28, wherein the leaching the copper includes introducing ammonia which complexes with copper.

Example 27: The method of any of examples 1-28, wherein the leaching the copper includes introducing glycine and ammonia which complexes with copper.

Example 28: The method of any of examples 1-28, wherein the leaching the copper includes introducing nitric acid as an oxidizing agent.

What is claimed is:

1. A method of leaching copper from a porphyry copper ore body within a subsurface volume of rock comprising:

forming an injection well adjacent to or within the porphyry copper ore body;

forming at least one lateral injection hole extending from the injection well;

stimulating the at least one lateral injection hole through the injection well under a hybrid stimulation phase, wherein the hybrid stimulation phase includes:

a first hydraulic fracturing phase at an injection rate and a pressure which exceeds a minimum principal horizontal stress ($Sh_{min}$) such that a first set of hydraulic fractures are formed which extend from the at least one lateral injection hole to intersect with a first set of natural fractures, a first hydroshearing phase, where the injection rate is held at a target rate until hydraulic fracture growth is allowed to arrest, and leak-off into natural fractures becomes a dominant pressure sink, mapping the first set of natural fractures during stimulation using a micro-seismic array to form a stimulated natural fracture map, and emplacing a proppant in the first set of hydraulic fractures and the first set of natural fractures to form a first set of stimulated propped hydraulic fractures and a first set of stimulated propped natural fractures;

drilling at least one production well adjacent to or within the first set of stimulated propped natural fractures using the stimulated natural fracture map;

completing at least one production well using a hybrid open hole completion where a production interval is completed using a blank liner and external casing packers;

stimulating the at least one production well under a second hydroshearing phase, where an injection pressure is held near $Sh_{min}$, such that a portion of the first set of natural fractures intersected by the production well are preferentially stimulated and intersect the porphyry copper ore body;

emplacing a proppant in the natural fractures intersected by the production well to form a stimulated reservoir including a set of stimulated propped natural fractures; and leaching copper from the porphyry copper ore body by contacting a leaching fluid with the porphyry copper ore body via the stimulated reservoir to form a copper-laden solution.

2. The method of claim 1, wherein the forming the injection well includes drilling the injection well, and introducing a casing and a lining within the injection well.

3. The method of claim 2, wherein forming the at least one lateral injection hole is performed using hydra-jetting or a perforation gun.

4. The method of claim 2, wherein the at least one lateral injection hole is formed in a direction of the $Sh_{min}$ toward the porphyry copper ore body.

5. The method of claim 2, wherein the injection well is from 150 to 4000 m in depth, and the at least one lateral injection hole includes 1 to 100 perforation or jetted zones which are spaced apart from 5 to 50 m.

6. The method of claim 1, wherein the hybrid stimulation phase further comprises introducing a chemical agent, wherein the chemical agent preferentially removes alteration minerals within the porphyry copper ore body.

7. The method of claim 6, wherein the chemical agent has a pH below 7.0 which preferentially dissolves silica as an alteration mineral.

8. The method of claim 6, wherein the chemical agent is alkaline.

9. The method of claim 6, wherein the introducing a chemical agent includes at least two treatment stages which include a first chemical treatment which targets alteration mineral including silica, and a second chemical treatment which targets clays, quartz and sulfides.

10. The method of claim 1, wherein the first hydroshearing phase comprises holding the target injection rate for a time determined by monitoring for a threshold decrease in micro-seismic events recorded by the micro-seismic array.

11. The method of claim 1, wherein the first hydroshearing phase comprises injecting a surfactant to increase pressure diffusion into the first set of natural fractures.

12. The method of claim 1, wherein the target rate is constant throughout the first hydroshearing phase.

13. The method of claim 1, wherein the hybrid stimulation phase further comprises cyclically jacking one or more hydraulic fractures by alternating between a first injection pressure above the $Sh_{min}$ and a second injection pressure below the first injection pressure, such that a stress orientation of $\sigma 2$ and $\sigma 3$ cyclically vary in a localized volume of rock proximal to the one or more hydraulic fractures so as to increase alignment of the stress orientation with the first set of stimulated natural fractures and increase hydroshearing in these natural fractures.

14. The method of claim 13, wherein the second injection pressure is below the $Sh_{min}$.

15. The method of claim 14, wherein the first injection pressure is 100 to 1000 psi above $Sh_{min}$ and the second injection pressure is 100 to 1000 psi (690 kPa to 6.9 MPa) below $Sh_{min}$.

16. The method of claim 13, wherein the injection pressure is cycled by stepwise increasing the injection pressure above the $Sh_{min}$ to the first injection pressure, and then stepwise decreasing the injection pressure to the second injection pressure.

17. The method of claim 16, wherein the stepwise pressure increase of the injection pressure is in increments of from 50 to 500 psi (345 kPa to 3.5 MPa).

18. The method of claim 1, wherein the at least one production well includes three to five production wells.

19. The method of claim 18, wherein the three to five production wells are stimulated and produced in series.

20. The method of claim 18, wherein the production wells are distributed around the injection well in a hub and spoke configuration, and are about equally distanced from the injection well.

21. The method of claim 18, wherein the production wells are completed within the production interval using the blank liner and external casing packers.

22. The method of claim 1, further comprising stimulating the at least one production well under a second hydraulic fracturing phase to form a second set of hydraulic fractures which intersect at least one of the first set of natural fractures and the second set of natural fractures, and which is insufficient to connect the second set of hydraulic fractures with the first set of hydraulic fractures.

23. The method of claim 1, further comprising introducing a diverter material to at least partially block a portion of the first set of natural fractures which are intersected by the at least one production well prior to stimulating the at least one production well under the second hydroshearing phase.

24. The method of claim 23, wherein the diverter material is a degradable diverter material.

25. The method of claim 1, wherein the leaching the copper includes introducing glycine which complexes with copper.

26. The method of claim 1, wherein the leaching the copper includes introducing ammonia which complexes with copper.

27. The method of claim 1, wherein the leaching the copper includes introducing glycine and ammonia which complexes with copper.

28. The method of claim 1, wherein the leaching the copper includes introducing nitric acid as an oxidizing agent.

* * * * *